US007354406B2

(12) United States Patent
Kim

(10) Patent No.: US 7,354,406 B2
(45) Date of Patent: Apr. 8, 2008

(54) EXERCISING APPARATUS FOR BODY LIPOLYSIS AND STRENGTHENING MUSCLES

(75) Inventor: Jong-Hwan Kim, Kyunggi-Do (KR)

(73) Assignee: Human Medextec Co. Ltd. (KR)

( * ) Notice: Subject to any disclaimer, the term of this patent is extended or adjusted under 35 U.S.C. 154(b) by 229 days.

(21) Appl. No.: 10/526,100

(22) PCT Filed: Jan. 14, 2005

(86) PCT No.: PCT/KR2005/000123

§ 371 (c)(1),
(2), (4) Date: Feb. 24, 2005

(87) PCT Pub. No.: WO2006/054814

PCT Pub. Date: May 26, 2006

(65) Prior Publication Data

US 2006/0155221 A1 Jul. 13, 2006

(30) Foreign Application Priority Data

Nov. 16, 2004 (KR) ..... 10-2004-0093341

(51) Int. Cl.

| | |
|---|---|
| ***A61H 1/00*** | (2006.01) |
| ***A61H 1/02*** | (2006.01) |
| ***A61H 5/00*** | (2006.01) |
| ***A61H 7/00*** | (2006.01) |
| ***A61H 19/00*** | (2006.01) |

(52) U.S. Cl. ..... 601/29; 601/27; 601/31; 601/90; 601/93; 601/100; 601/104

(58) Field of Classification Search ..... 601/23, 601/27, 29, 30–32, 34, 35, 84, 86, 87, 89, 601/90, 93, 98, 100, 101, 104
See application file for complete search history.

(56) References Cited

U.S. PATENT DOCUMENTS 3,540,436 A * 11/1970 Hueftle, Jr. ..... 601/35

(Continued)

FOREIGN PATENT DOCUMENTS

JP 8-89597 4/1996

(Continued)

OTHER PUBLICATIONS

PCT International Search Report; International Application No. PCT/KR2005/000123; International Filing Date: Jan. 14, 2005; Date of Mailing: Aug. 12, 2005.

(Continued)

*Primary Examiner*—Justine R. Yu
*Assistant Examiner*—Kristen C. Matter
(74) *Attorney, Agent, or Firm*—Cantor Colburn LLP

(57) ABSTRACT

As one of exercising apparatuses, in particular an exercising apparatus giving exercising effect by contracting and relaxing user's muscles, an exercising apparatus which includes at least one motion unit including a moving unit installed at one end thereof with a hinge unit rotatably fixed; and an up-and-down reciprocating unit connected with the other end of the moving unit, the up-and-down reciprocating unit reciprocating upward and downward and making the moving unit rotate in an angular interval, and a driving unit connected with the up-and-down reciprocating unit of the motion unit, the driving unit driving the up-and-down reciprocating unit to reciprocate upward and downward is disclosed.

25 Claims, 23 Drawing Sheets

U.S. PATENT DOCUMENTS

| | | | | |
|---|---|---|---|---|
| 5,263,909 | A * | 11/1993 | Ehrenfried | 482/52 |
| 5,443,439 | A * | 8/1995 | Ohshita | 601/90 |
| 5,500,002 | A * | 3/1996 | Riddle et al. | 606/242 |
| 6,217,491 | B1 | 4/2001 | Schiessl | 482/92 |
| 6,659,918 | B2 | 12/2003 | Schiessl | 482/92 |
| 2005/0033203 | A1 * | 2/2005 | Son | 601/98 |

FOREIGN PATENT DOCUMENTS

| | | |
|---|---|---|
| JP | 08-089597 | 4/1996 |
| KR | 10-2004-0062513 | 7/2004 |
| KR | 10-2004-0062513 A | 7/2004 |
| KR | 10-2004-0064912 | 7/2004 |
| KR | 10-2004-0064912 A | 7/2004 |

OTHER PUBLICATIONS

Korean Intellectual Property Office, PCT International Search Report, Date of Mailing: Aug. 12, 2005.

* cited by examiner

EXERCISING APPARATUS FOR BODY LIPOLYSIS AND STRENGTHENING MUSCLES

FIELD OF THE INVENTION

The present invention relates to an exercising apparatus, in particular to an exercising apparatus giving exercising effect by contracting and relaxing user's muscles.

BACKGROUND OF THE INVENTION

An exercising apparatus is an apparatus with which a user exercises by contracting and relaxing the muscles. As examples of an exercising apparatus, there is running machine, stationary bicycle, stepper, etc. as well as callisthenic iron dumbbell or dumbbell.

Meanwhile, the conventional exercising apparatus has a problem that a user should actively move by himself/herself by using his/her physical strength in order to take exercise.

In particular, the conventional exercising apparatus needs a user's active motion, so that a disabled person unable to actively move cannot use the exercising apparatus.

SUMMARY OF THE INVENTION

Technical Problem

Therefore, it is an object of the present invention to provide an exercising apparatus which needs not a user's active motion.

It is another object of the present invention to provide an exercising apparatus which stably supports a user's hand or foot and performs an up-and-down motion.

Technical Solution

To achieve these objects, there is provided an exercising apparatus which includes at least one motion unit including a moving unit installed at one end thereof formed with a hinge unit rotatably fixed, and an up-and-down reciprocating unit connected with the other end of the moving unit, the up-and-down reciprocating unit reciprocating upward and downward and making the moving unit rotate in an angular interval; and a driving unit connected with the up-and-down reciprocating unit of the motion unit, the driving unit driving the up-and-down reciprocating unit to reciprocate upward and downward.

A pair of the motion units may be arranged in a longitudinal direction thereof, and the hinge units of the pair of the motion units may face each other.

A pair of the motion units may be arranged in a longitudinal direction thereof, and the hinge units are arranged in the respective ends of the pair of the motion units.

The up-and-down reciprocating unit may include a driving unit connecting shaft to which rotating force is transmitted from the driving unit; an eccentric rotary shaft eccentrically connected with the driving unit connecting shaft; and at least one link unit, one end of the link unit hingedly connected with the other end of the moving unit, and the other end of the link unit rotatably connected with the eccentric rotary shaft.

The up-and-down reciprocating units of the respective motion units may be coupled with each other by a motion coupling unit restricting an angular difference between the respective eccentric rotary shafts and restricting up-and-down motion of each link unit.

The motion coupling unit may be a link member of which one end is rotatably connected with the eccentric rotary shaft or the driving unit connecting shaft of one of the pair of motion units, and the other end of which is rotatably connected with the eccentric rotary shaft or the driving unit connecting shaft of the other motion unit.

The motion coupling unit may include pulleys respectively connected with the driving unit connecting shaft of the pair of the motion units, and a belt connecting the pulleys.

The pulleys may have an outer surface having tooth structure, and the belt has an inner surface having tooth structure corresponding to the tooth structure of the pulleys.

The eccentric rotary shaft may be connected with a balance weight having a center of weight in an angular difference of 180° from the center of the eccentric rotary shaft centering to the rotation center of the eccentric rotary shaft, and the motion coupling unit may be comprised of a connecting pin installed on the balance weight having an angular difference of 180° from the center of the eccentric rotary shaft centering the rotation center of the eccentric rotary shaft, and a link member rotatably connected with the connecting pins.

Both ends of the eccentric rotary shaft may be respectively connected to a pair of concentric shafts having the same center.

The pair of concentric shafts may be rotatably supported by a shaft supporting bracket.

One end of any one of the pair of the concentric shafts may be further connected with a balance weight eccentrically from the concentric shaft.

The eccentric rotary shafts of the pair of the motion units may have an angular difference of 0°~180° with each other.

The number of the link unit may be two.

The driving unit connecting shaft may be connected with a driving shaft of the driving unit by a rotation transmitting unit, the rotation transmitting unit transmitting rotation from the driving unit to the driving unit connecting shaft.

The rotation transmitting unit may include a driving pulley connected with the driving shaft; a slave pulley connected with the driving unit connecting shaft; and a belt connecting the driving pulley with the slave pulley.

Outer surfaces of the driving pulley and the slave pulley may have a tooth structure, and an inner surface of the belt may have a tooth structure corresponding to the tooth structure of the driving pulley and the slave pulley.

Two pairs of the motion units may be arranged in two rows.

The moving units of the motion units positioned in the same side may have any one of up-and-down motions of a motion of crossing each other, a motion of equal motion and an irregular motion.

The respective eccentric rotary shafts of the motion units may have an angular difference of 0°~180° with the facing eccentric rotary shaft.

The driving unit is positioned at a center of the pair of the motion units, and a driving shaft of the driving unit is connected with the driving unit connecting shaft by a rotation transmitting unit.

The rotation transmitting unit may be comprised of a belt, chain or link member.

The rotation transmitting unit may include a main rotary shaft connected with the driving shaft; a main shaft supporting bracket rotatably supporting the main rotary shaft; first eccentric shaft connected with the main rotary shaft, the first eccentric shaft having a center eccentric from the rotation center of the main rotary shaft; second eccentric shaft having a center eccentric from the rotation center of the main rotary shaft; and first link member and second link member, in which the respective ends of the first link member are respectively connected with the first eccentric shaft and the eccentric rotary shaft of one of the motion unit and the respective ends of the second link member are respectively connected with the second eccentric shaft and the eccentric rotary shaft of the other motion unit.

The center of the first eccentric shaft may have an angular difference of 0°~180° with the center of the second eccentric shaft centering the rotation center of the main rotary shaft.

A pair of the motion units may be arranged in parallel to each other.

The up-and-down reciprocating unit may include a driving unit connecting shaft being transmitted with rotation force from the driving shaft; an eccentric rotary shaft eccentrically connected with the driving unit connecting shaft; and at least one link unit, one end of the link unit hingedly connected with the other end of the moving unit, and the other end of the link unit rotatably connected with the eccentric rotary shaft.

The number of the link unit may be two.

The driving unit connecting shaft is connected with a driving shaft of the driving unit by a rotation transmitting unit, the rotation transmitting unit transmitting rotation force from the driving unit to the driving unit connecting shaft.

The rotation transmitting unit may be comprised of any one of a coupler, a combination of a belt and pulleys, chain and crank.

Both ends of the eccentric rotary shaft may be respectively connected to a pair of concentric shafts having the same center.

The pair of the concentric shafts may be rotatably supported by a shaft supporting bracket.

The driving unit may be connected with the driving unit connecting shaft of any one of the pair of motion units, and the up-and-down reciprocating unit of the motion unit connected with the driving unit may be connected with the driving unit connecting shaft of the up-and-down reciprocating unit of the other motion unit by a connection shaft.

The up-and-down reciprocating unit may include a concentric shaft rotatably supported by a shaft supporting bracket; an eccentric rotary shaft connected with at least one end of the concentric shaft, the eccentric rotary shaft being eccentric from the rotation center of the concentric shaft; and a link unit, one end of the link unit rotatably connected with the eccentric rotary shaft and the other end of the link unit hingedly connected with the moving unit, and the driving unit is connected with one of the concentric shaft and the eccentric rotary shaft in order to transmit rotation thereto.

The driving shaft of the driving unit may be connected with the concentric shaft by a rotation transmitting unit, and the rotation transmitting unit may transmit the rotation force from the driving shaft to the concentric shaft.

The rotation transmitting unit may include pulleys respectively connected with the driving shaft and the concentric shaft and a belt connecting the pulleys.

The driving shaft of the driving unit may be connected with the eccentric rotary shaft by a coupler.

The driving unit may be a motor having a pair of driving shafts respectively at ends of the motor, the respective driving shafts are connected with the driving unit connecting shafts of the respective motion units by a rotation transmitting unit.

The rotation transmitting unit may include pulleys respectively connected with the driving shaft and the concentric shaft and a belt connecting the pulleys.

The hinge unit may be installed between a center portion of the moving unit and one end of the moving unit.

The up-and-down reciprocating unit may include a concentric shaft rotatably supported by a shaft supporting bracket; a pair of eccentric rotary shafts respectively connected with ends of the concentric shaft, the pair of eccentric rotary shafts being eccentric from to a rotation center of the concentric shaft; and a pair of link units, one end of the link unit rotatably connected with the eccentric rotary shaft and the other end of the link unit hingedly connected with the moving unit, and the driving unit is connected with one of the concentric shaft and the eccentric rotary shaft for transmitting rotation force thereto.

The driving shaft of the driving unit and the concentric shaft may be connected with each other by a combination of a belt and pulleys.

The pair of the eccentric rotary shafts may have an angular difference of 0°~180° with each other.

BRIEF DESCRIPTION OF THE INVENTION

Figure 2:
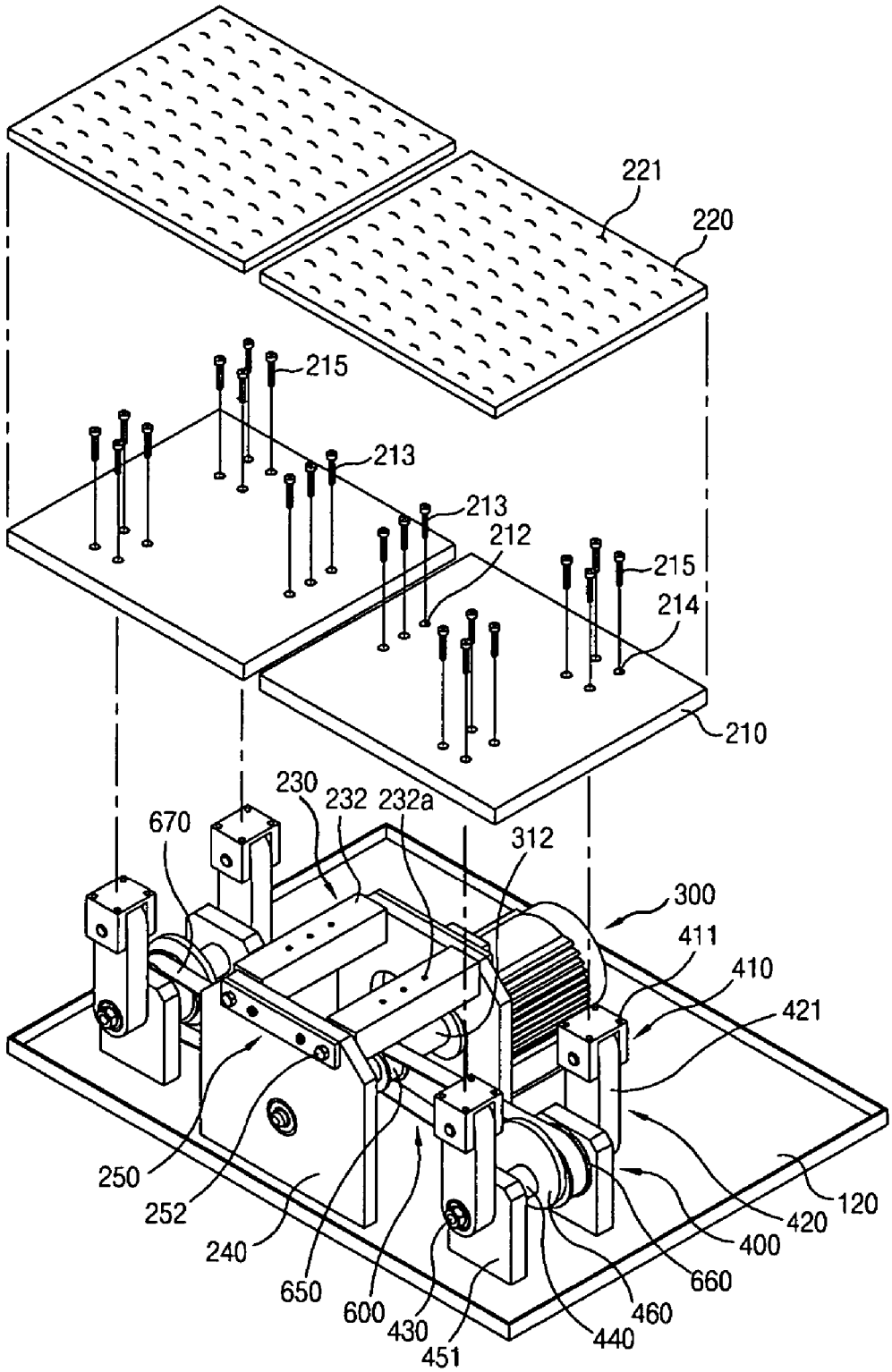
FIG. 2 is a disassembled perspective view showing the exercising apparatus in accordance with the first embodiment of the present invention.
Figure 3A:
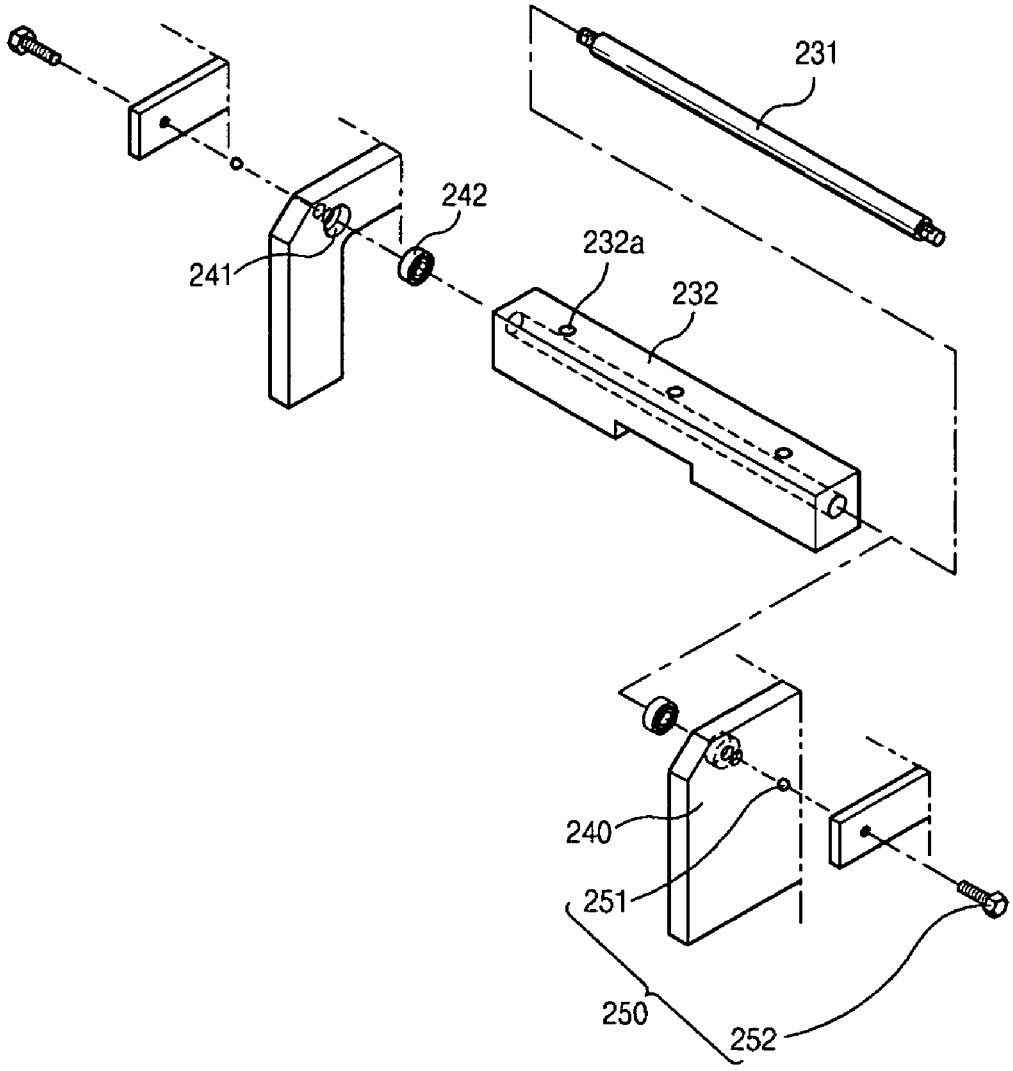

FIG. 3*a* is a disassembled perspective view showing a principal part of the exercising apparatus in FIG. 2.

Figure 3B:
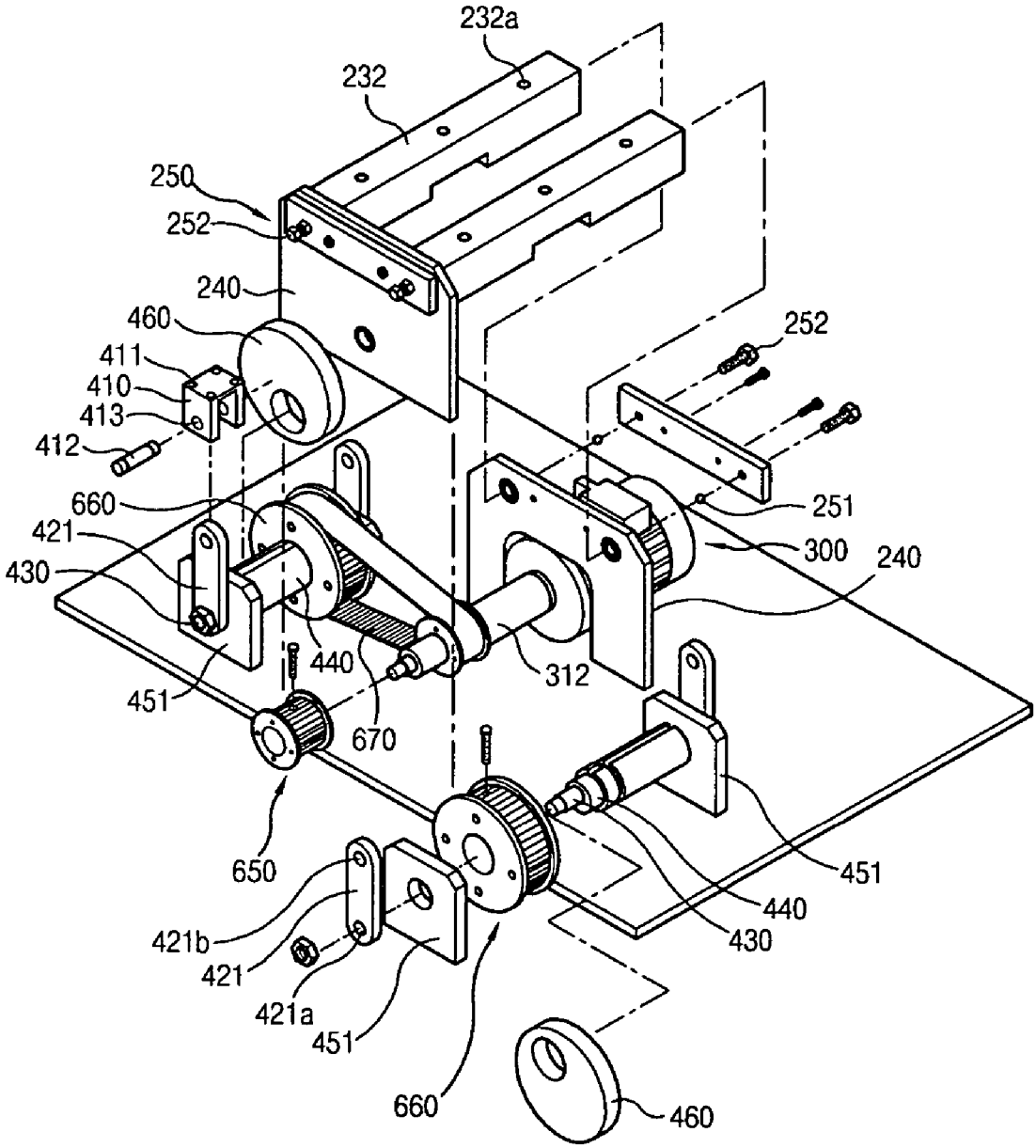

FIG. 3*b* is a disassembled view showing the hinge unit of the exercising apparatus in FIG. 2.

Figure 1:
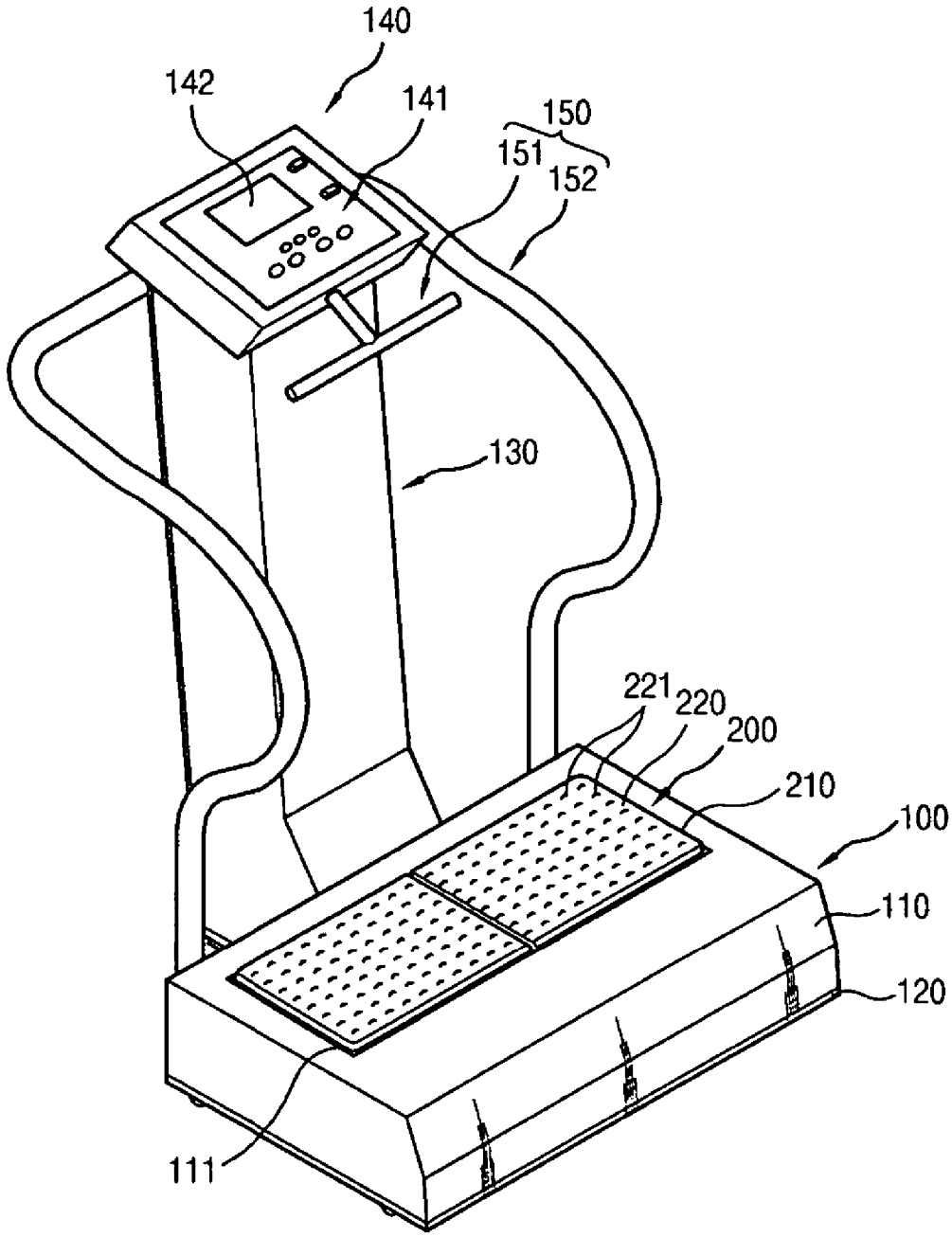
FIG. 1 is a perspective view showing the exercising apparatus in accordance with the present invention.
Figure 4:
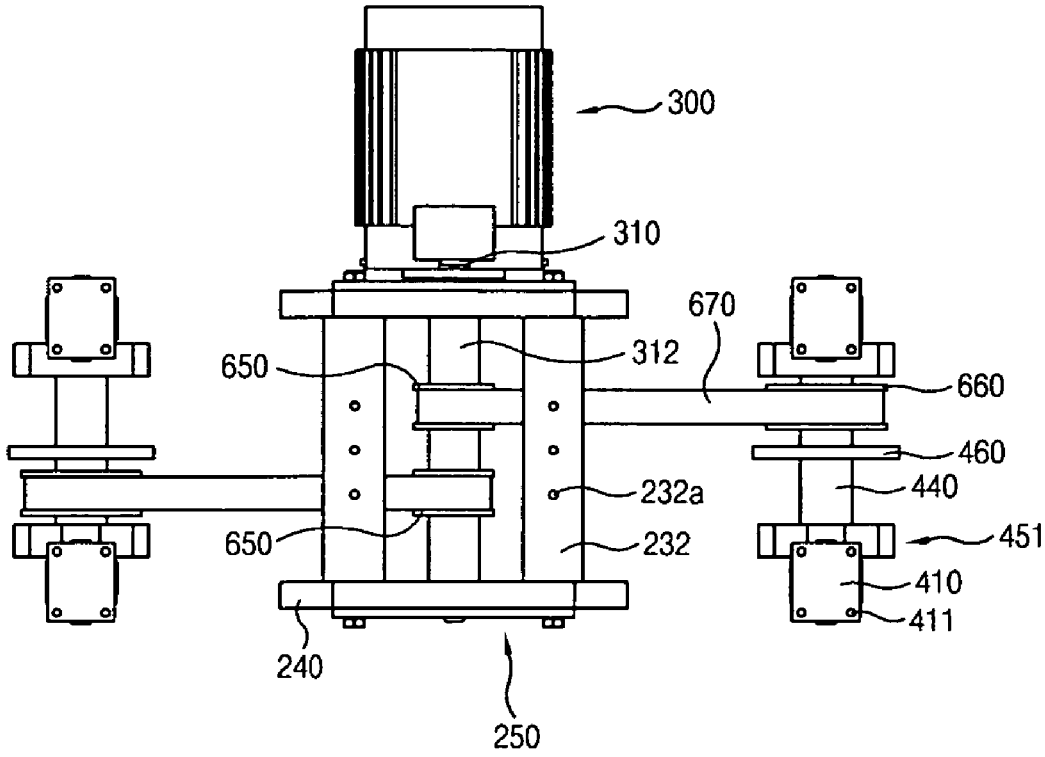

FIG. 4 is a plane view showing a principal part of the exercising apparatus in FIG. 1.

Figure 5:
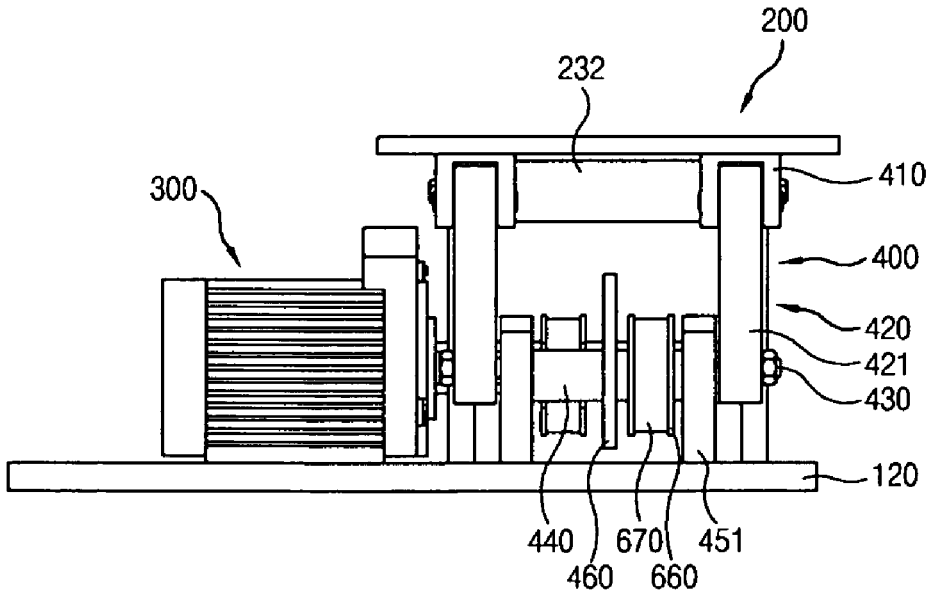

FIG. 5 is a side view showing a principal part of the exercising apparatus in FIG. 1.

Figure 6:
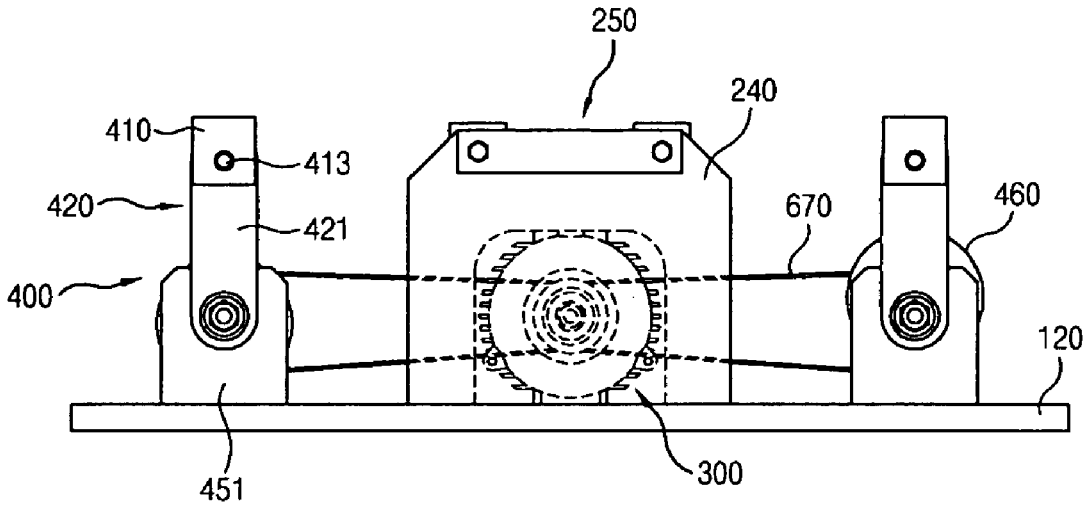

FIG. 6 is a front view showing the motion unit of the exercising apparatus in FIG. 1.

Figure 7:
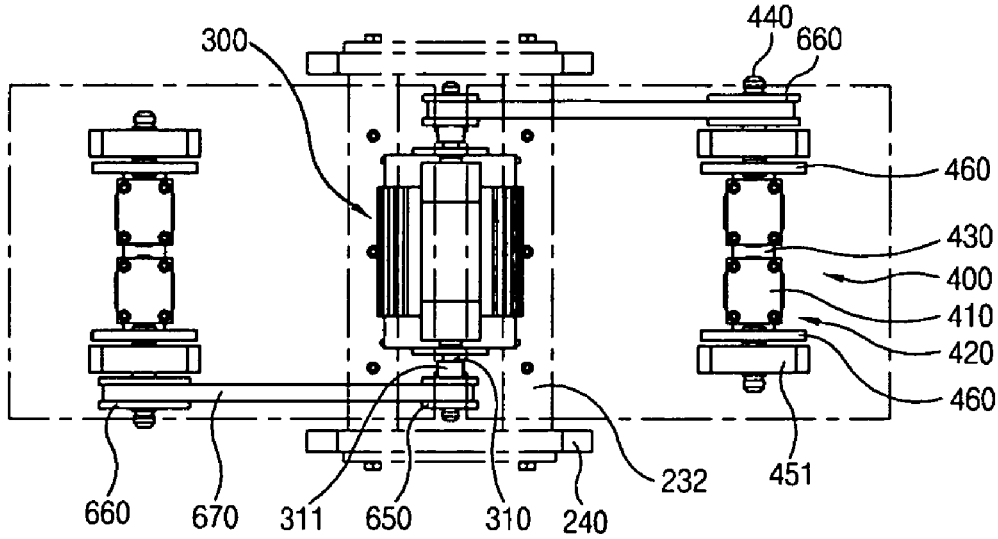

FIG. 7 is a plane view showing the modified exercising apparatus in FIG. 1.

Figure 8:
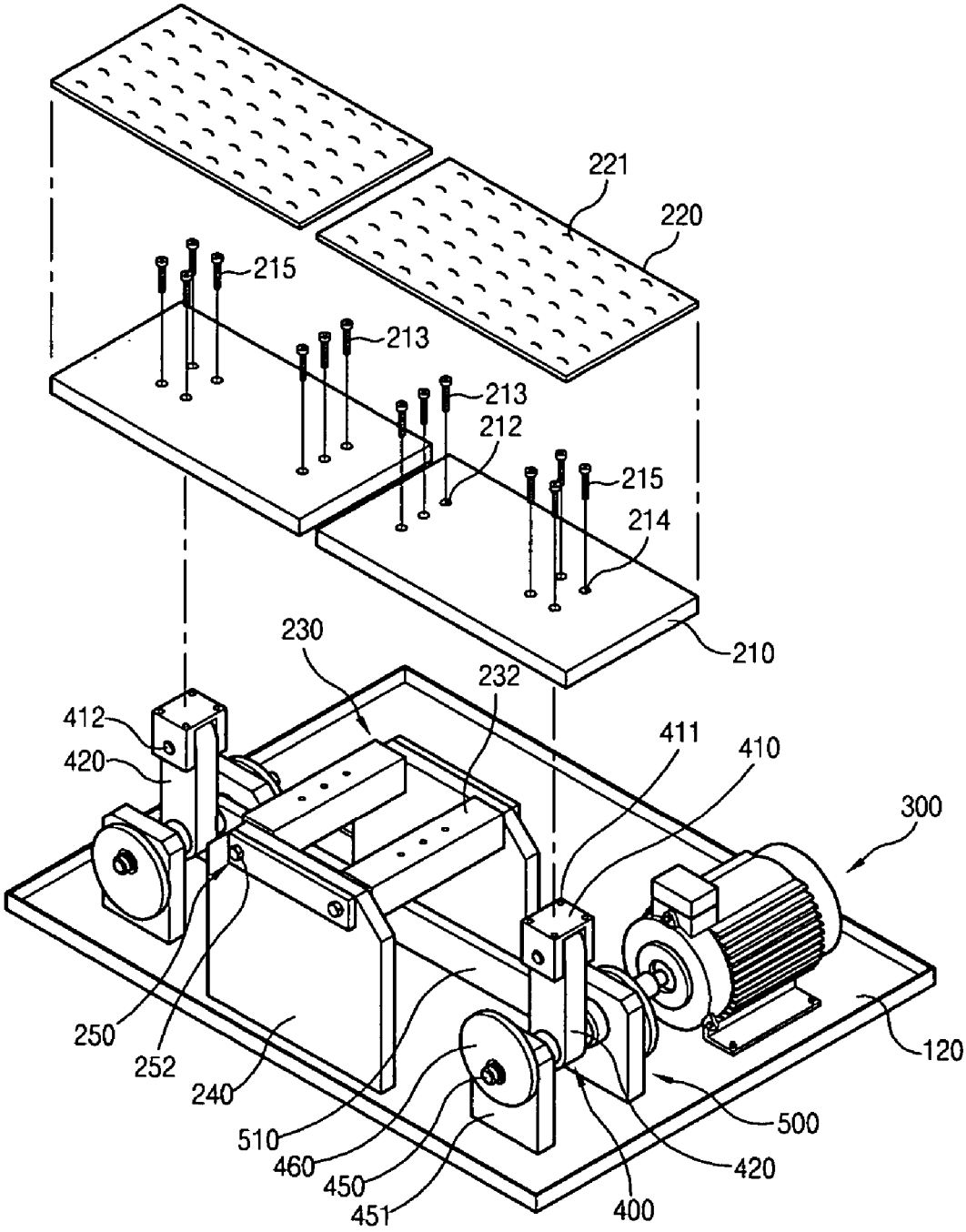

FIG. 8 is a disassembled perspective view showing the exercising apparatus in accordance with the second embodiment of the present invention.

Figure 9:
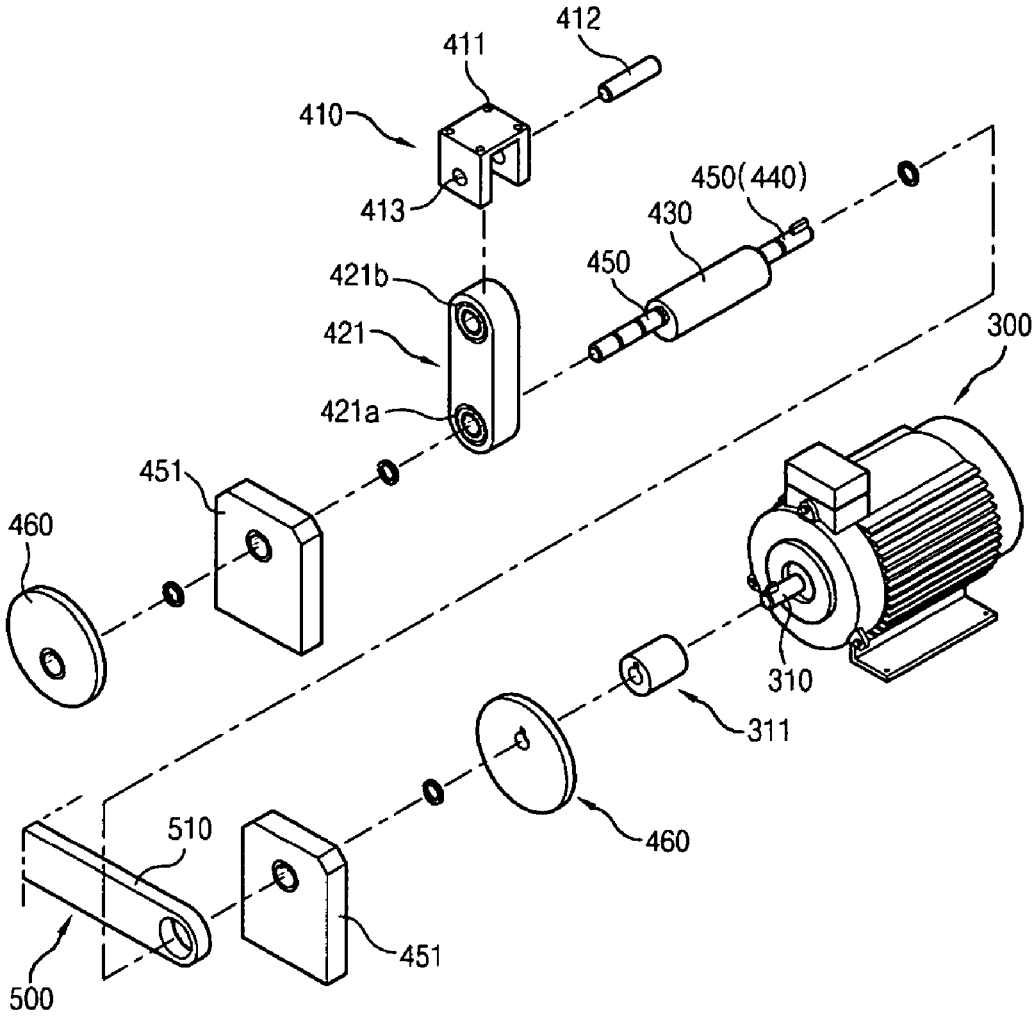

FIG. 9 is a disassembled perspective view showing a principal part of the exercising apparatus in FIG. 8.

Figure 10:
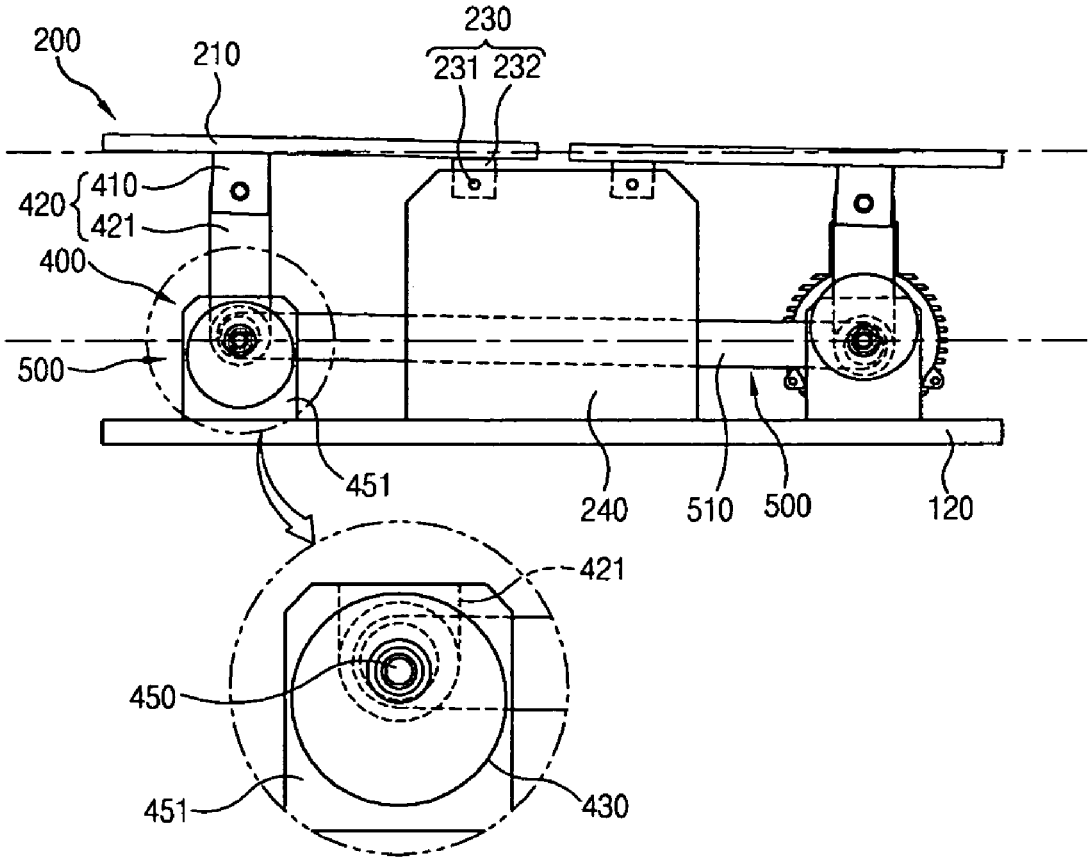

FIG. 10 is a front view showing a principal part of the exercising apparatus in FIG. 8.

Figure 11:
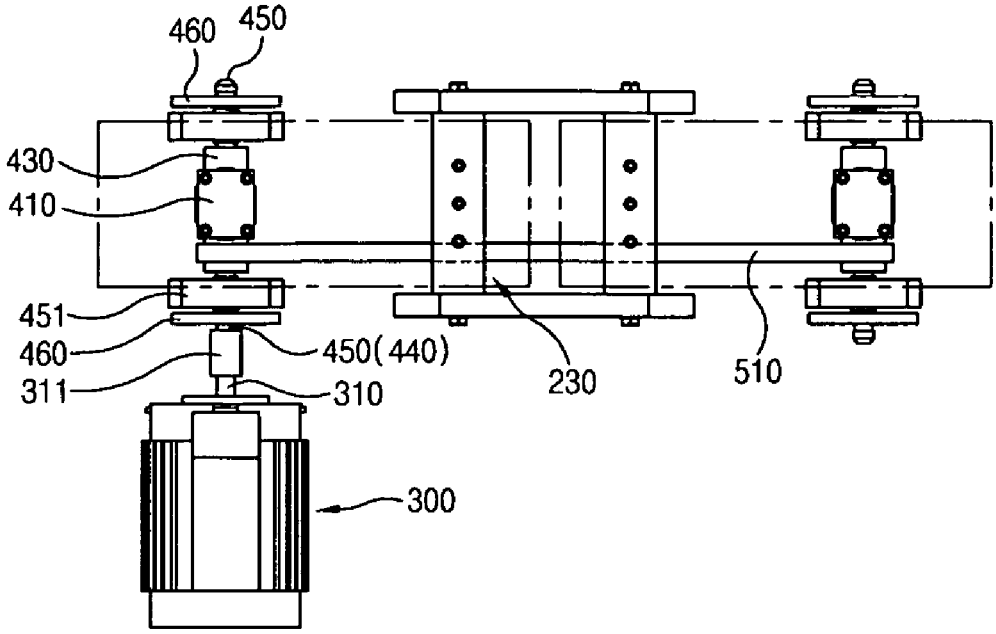

FIG. 11 is a plane view showing a principal part of the exercising apparatus in FIG. 8.

Figure 12:
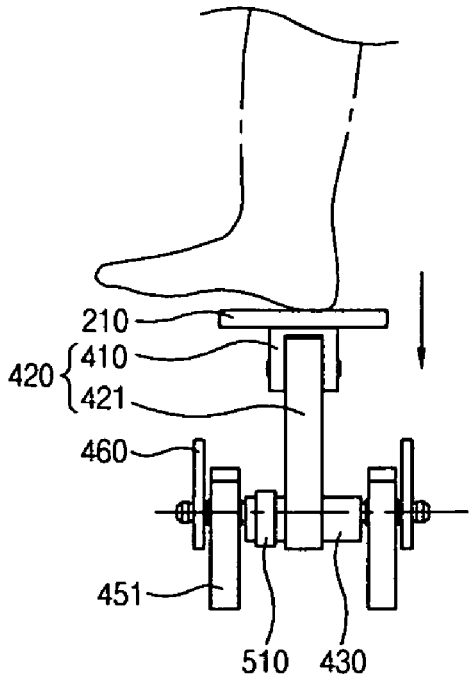

FIG. 12 is a side view showing the motion unit of the exercising apparatus in FIG. 8.

Figure 13:
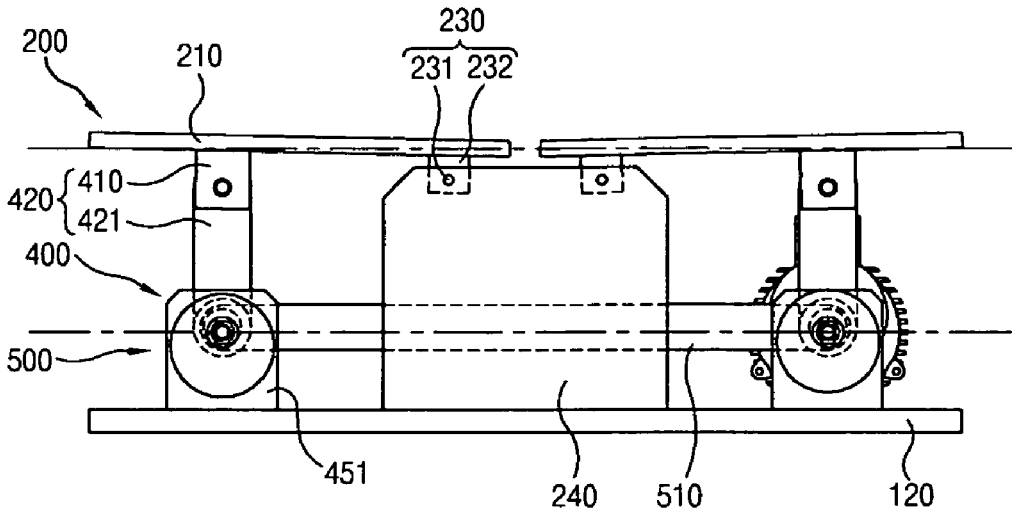

FIG. 13 is a front view showing the modified one of the exercising apparatus in FIG. 8.

Figure 14A:
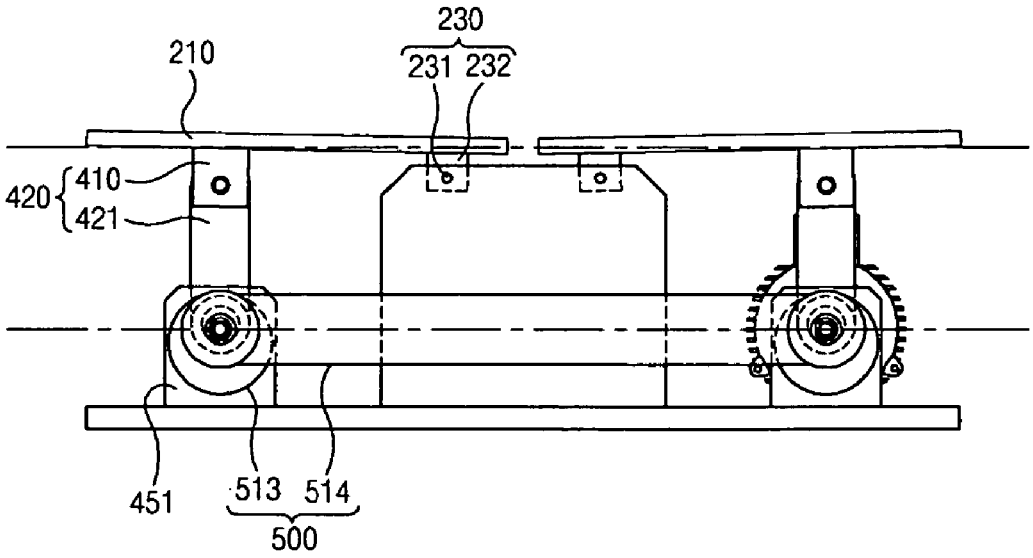

FIG. 14*a* is a front view showing another modified exercising apparatus in FIG. 8.

Figure 14B:
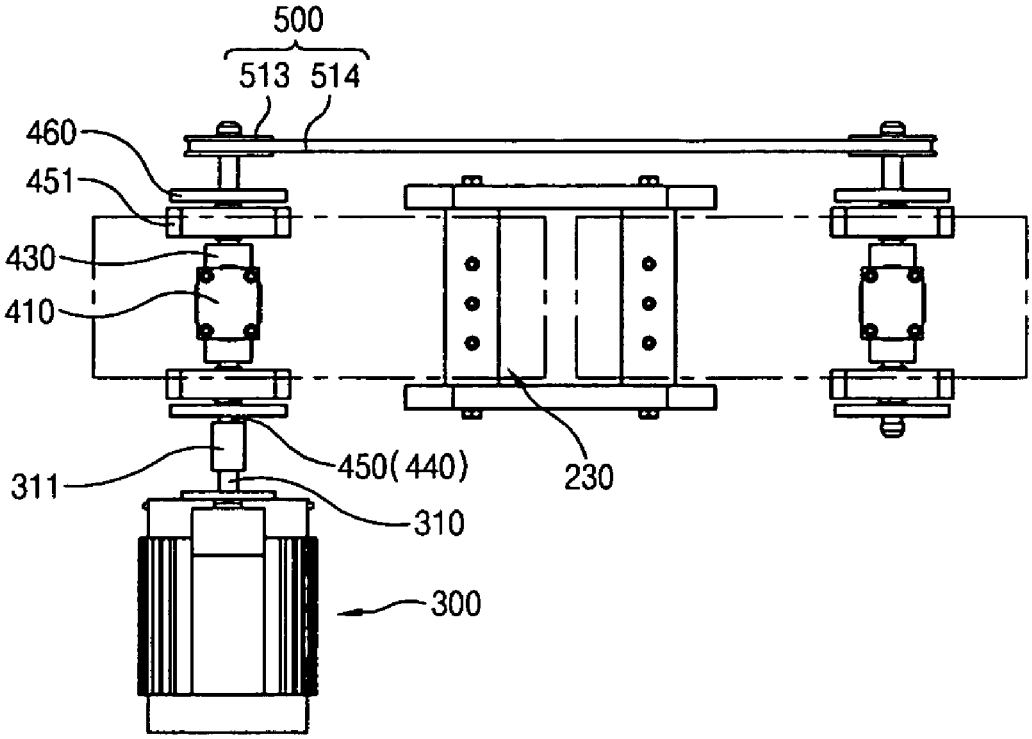

FIG. 14*b* is a plane view showing the exercising apparatus in FIG. 14*a*.

Figure 14C:
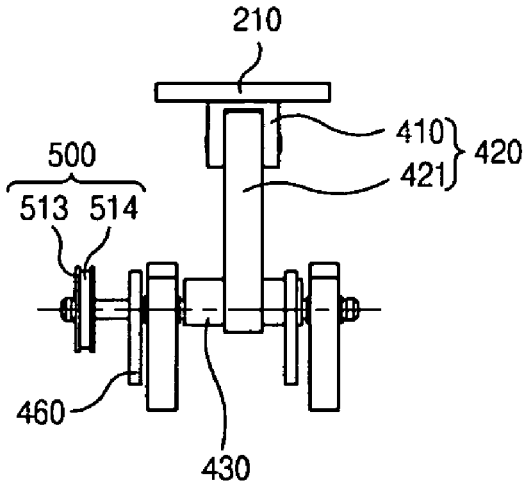

FIG. 14*c* is a side view showing the motion unit of the exercising apparatus in FIG. 14*a*.

Figure 15A:
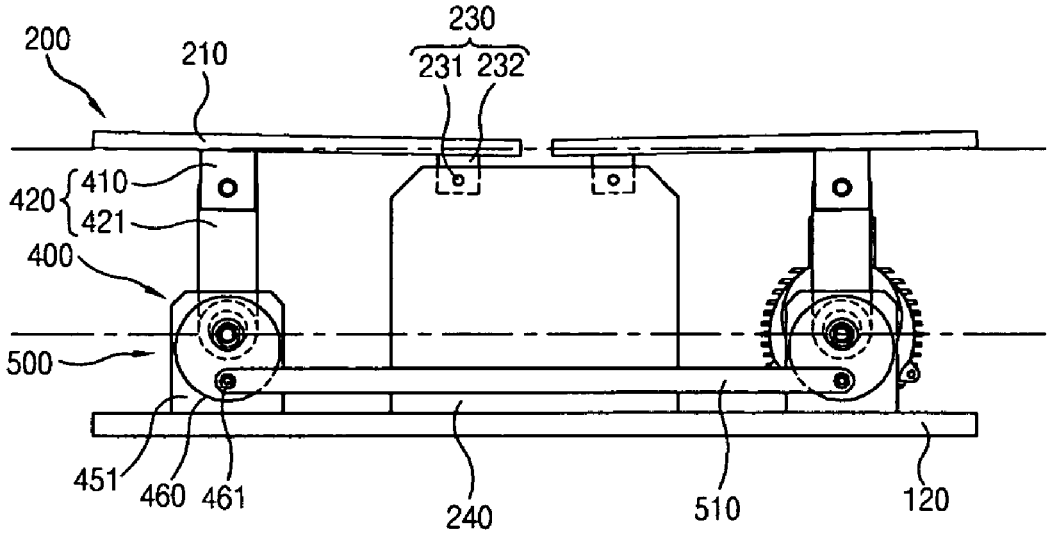

FIG. 15*a* is a front view showing the other modified exercising apparatus in FIG. 8.

Figure 15B:
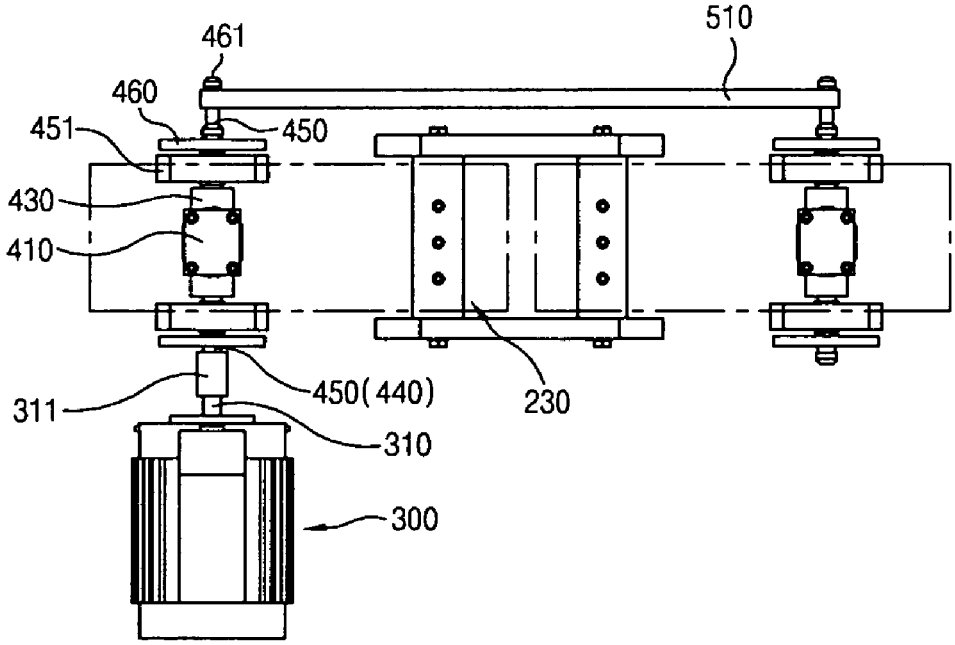

FIG. 15*b* is a plane view showing the exercising apparatus in FIG. 15*a*.

Figure 15C:
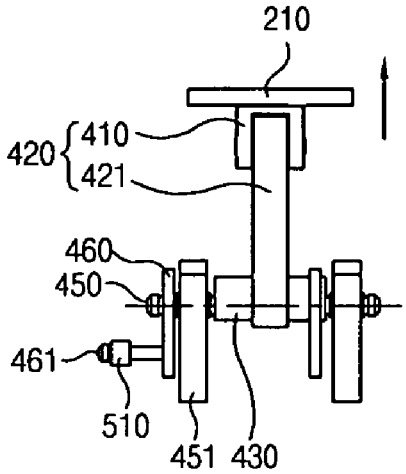

FIG. 15*c* is a side view showing the motion unit of the exercising apparatus in FIG. 15*a*.

Figure 16:
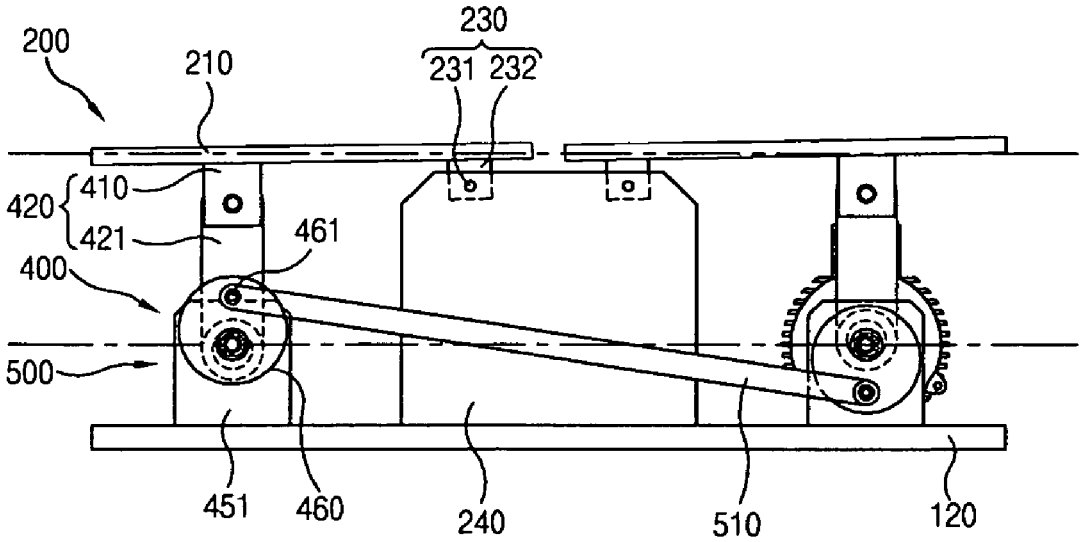

FIG. 16 is a plane view showing the other modified exercising apparatus in FIG. 8.

Figure 17:
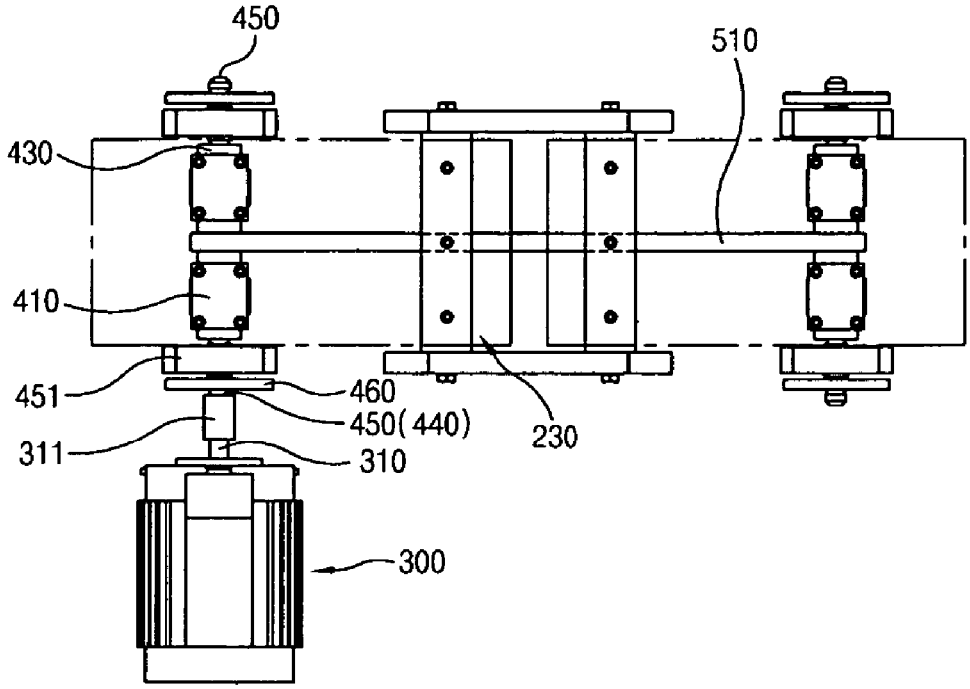

FIG. 17 is a plane view showing the other modified exercising apparatus in FIG. 8.

Figure 18:
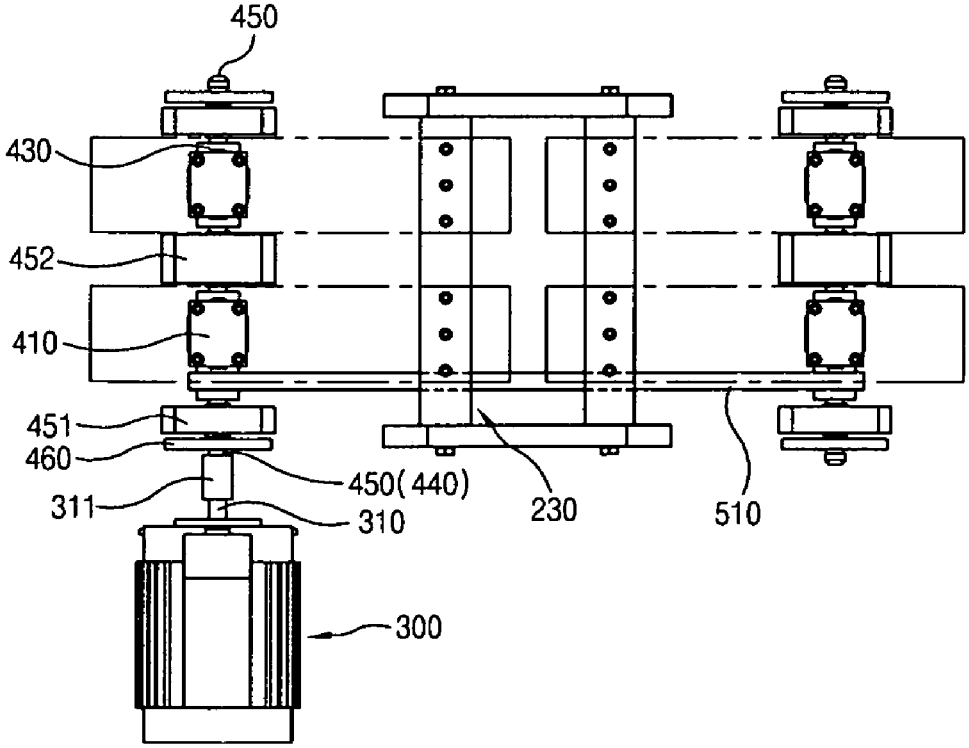

FIG. 18 is a plane view showing the exercising apparatus in accordance with the third embodiment of the present invention.

Figure 19A:
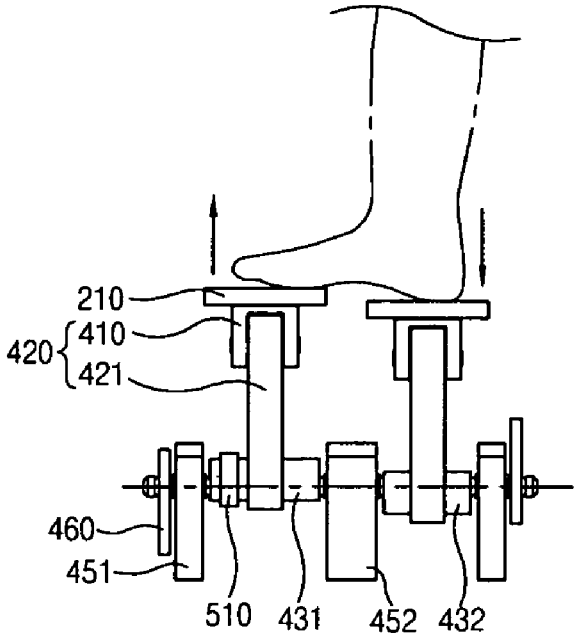

FIG. 19*a* is a side view showing the motion unit of the exercising apparatus in FIG. 18.

Figure 19B:
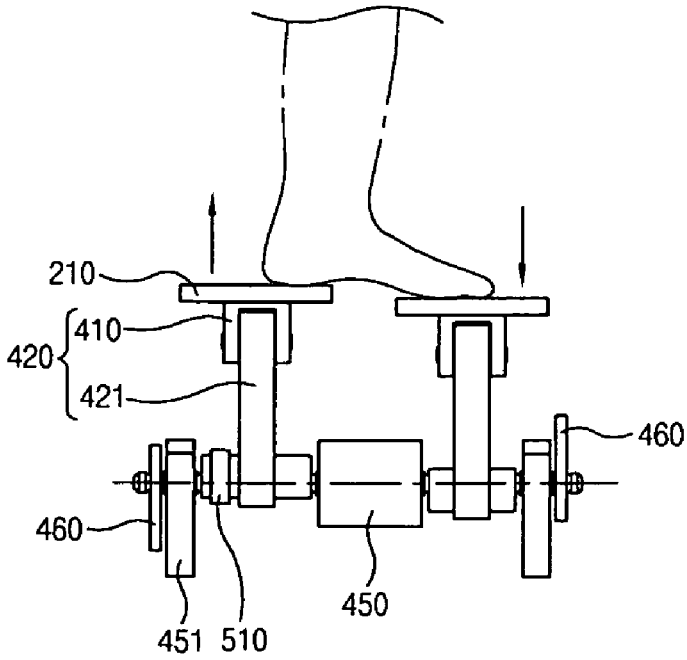

FIG. 19*b* is a side view showing the modified motion unit of the exercising apparatus in FIG. 18.

Figure 19C:
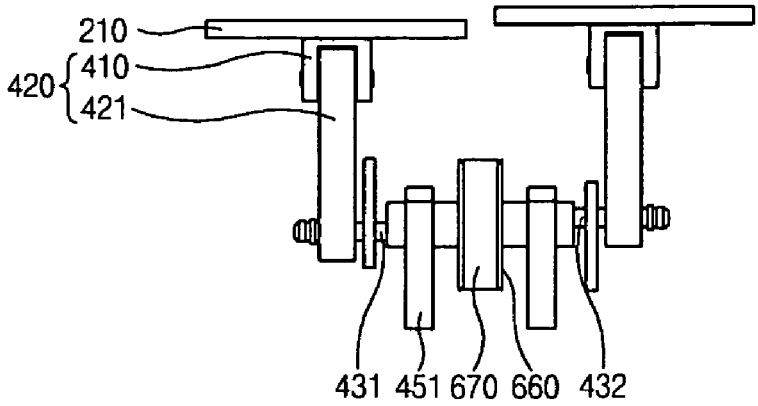

FIG. 19*c* is a side view showing another modified motion unit of the exercising apparatus in FIG. 18.

Figure 20:
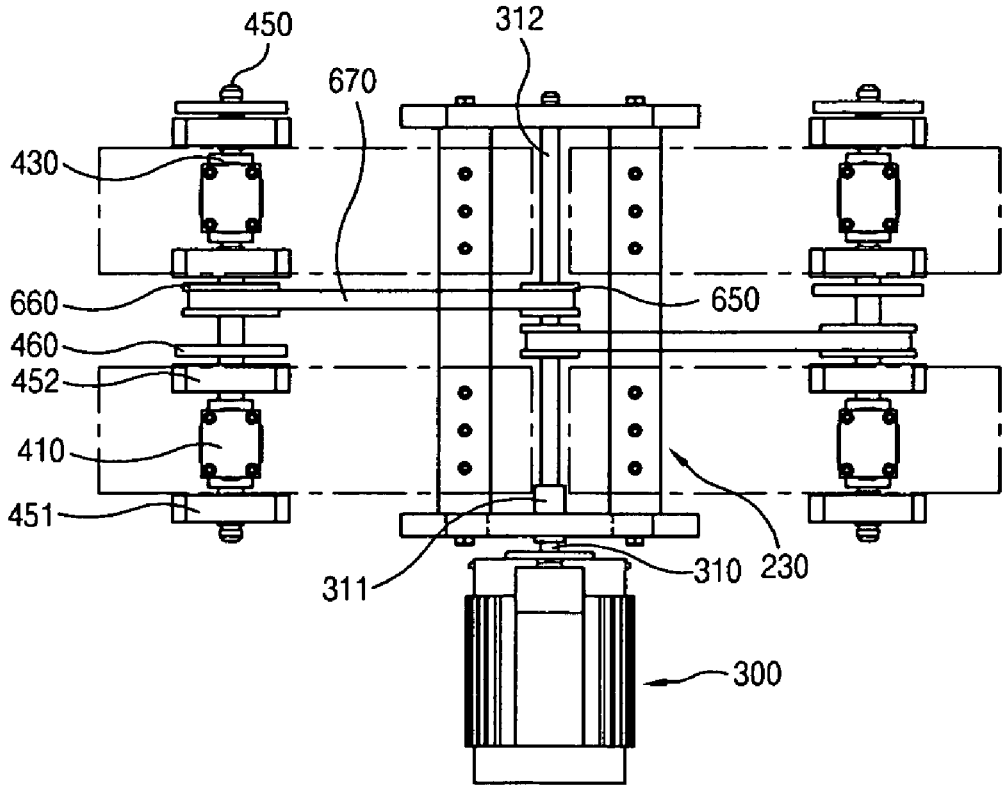

FIG. 20 is a plane view showing the modified exercising apparatus in FIG. 18.

Figure 21:
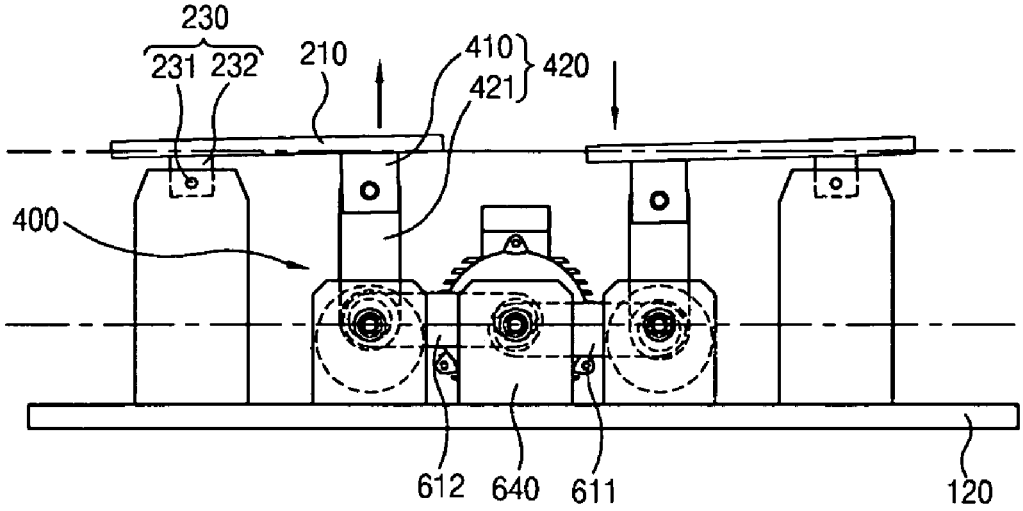

FIG. 21 is a front view showing the exercising apparatus in accordance with the fourth or fifth embodiment of the present invention.

Figure 22:
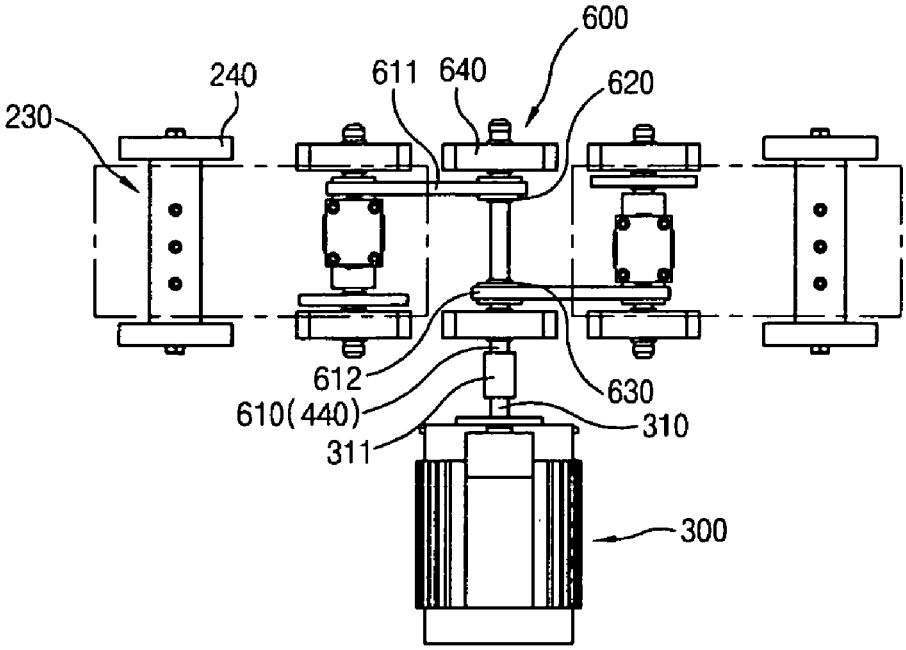

FIG. 22 is a plane view showing the exercising apparatus in FIG. 21.

Figure 23:
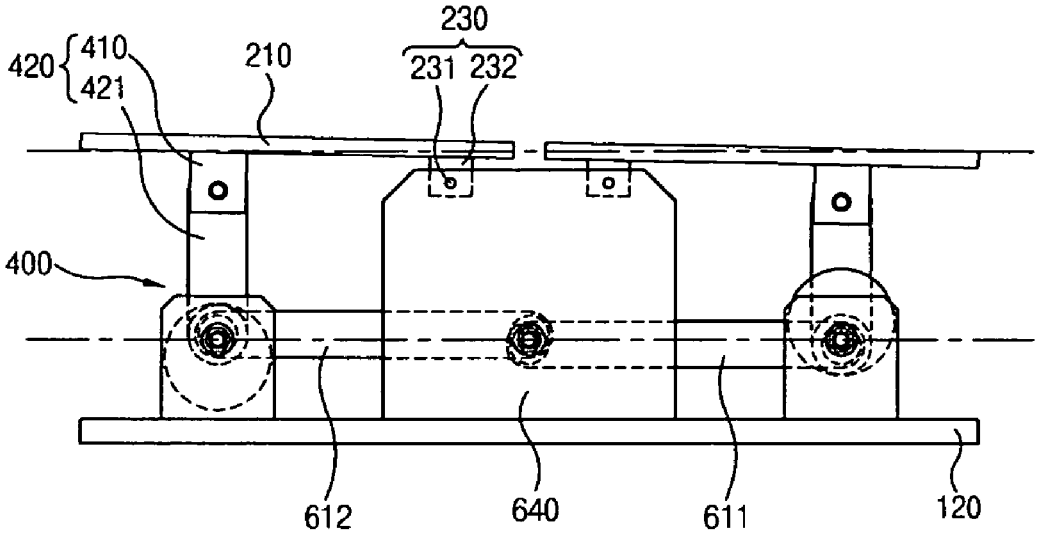

FIG. 23 is a front view showing the modified exercising apparatus in FIG. 21.

Figure 24:
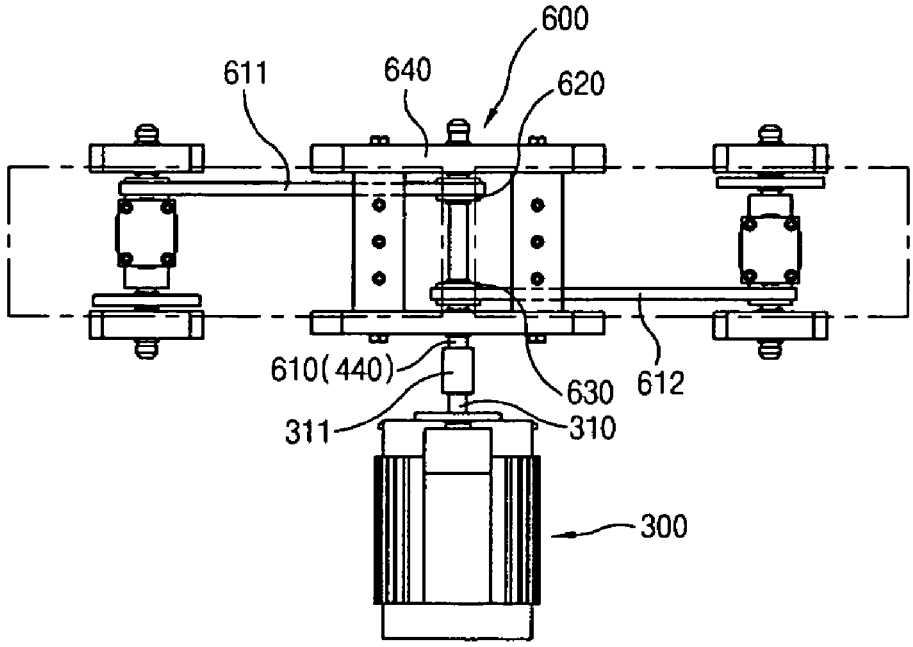

FIG. 24 is a plane view showing the exercising apparatus in FIG. 23.

Figure 25A:
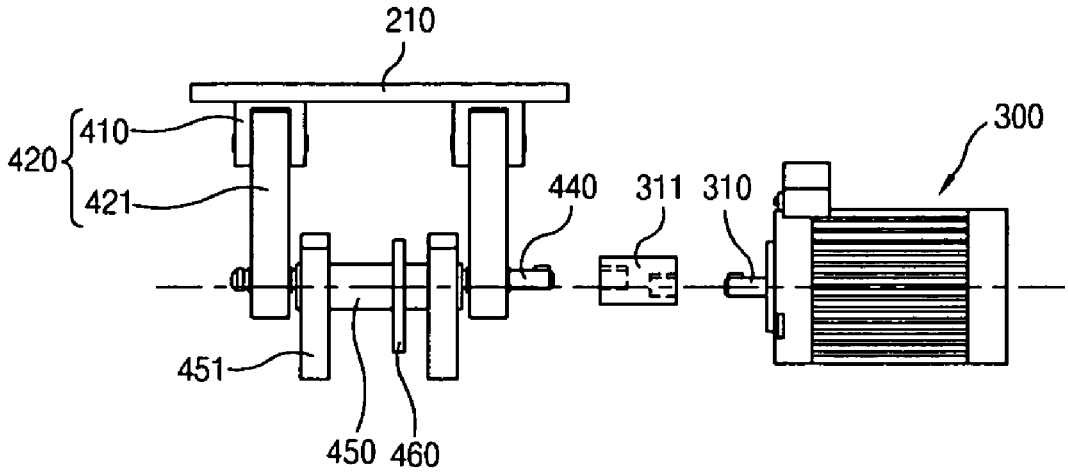

FIG. 25*a* is a side view showing the exercising apparatus in accordance with the sixth embodiment of the present invention.

Figure 25B:
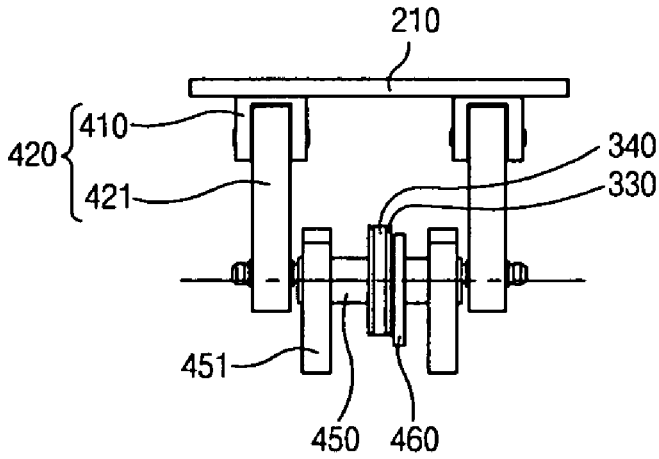

FIG. 25*b* is a side view showing the modified exercising apparatus in FIG. 25*a*.

Figure 26:
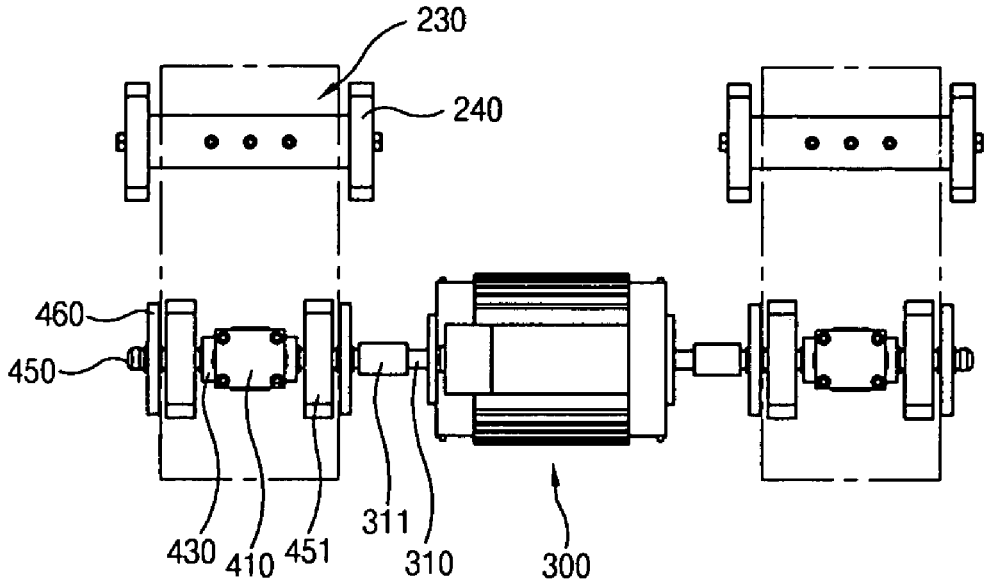

FIG. 26 is a plane view showing the exercising apparatus in accordance with the seventh embodiment of the present invention.

Figure 27:
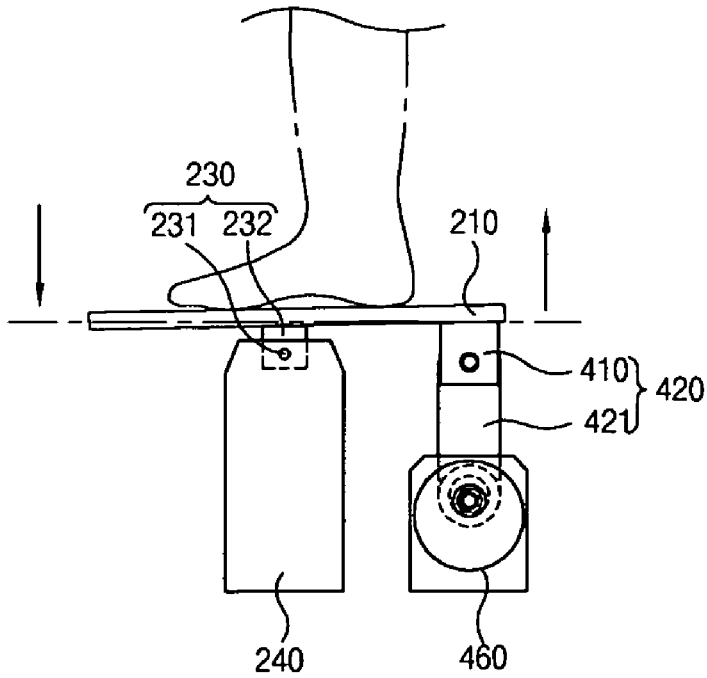

FIG. 27 is a side view showing the modified motion unit of the exercising apparatus in FIG. 26.

Figure 28:
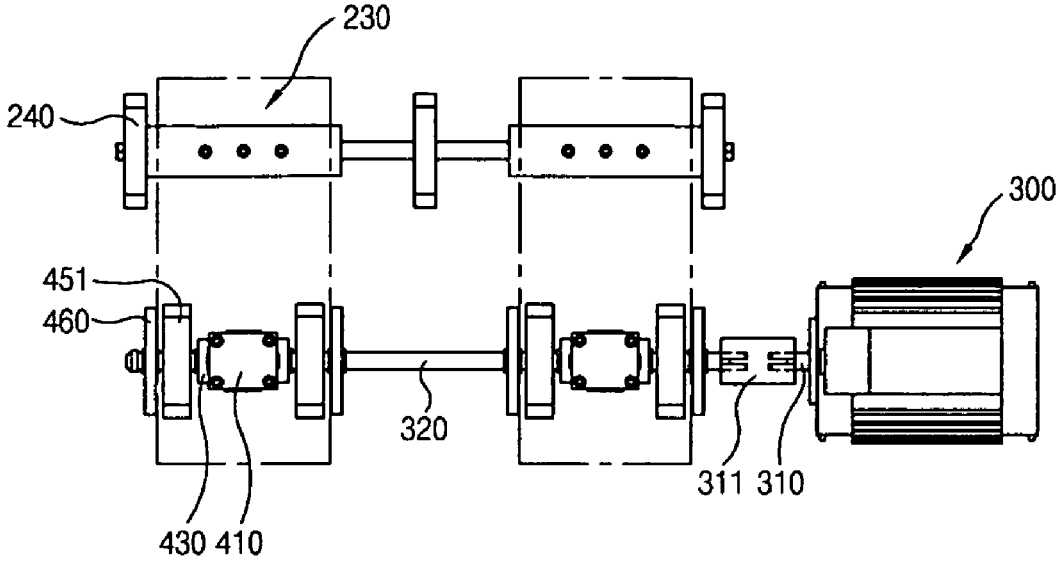

FIG. 28 is a plane view showing the modified exercising apparatus in FIG. 26.

Figure 29:
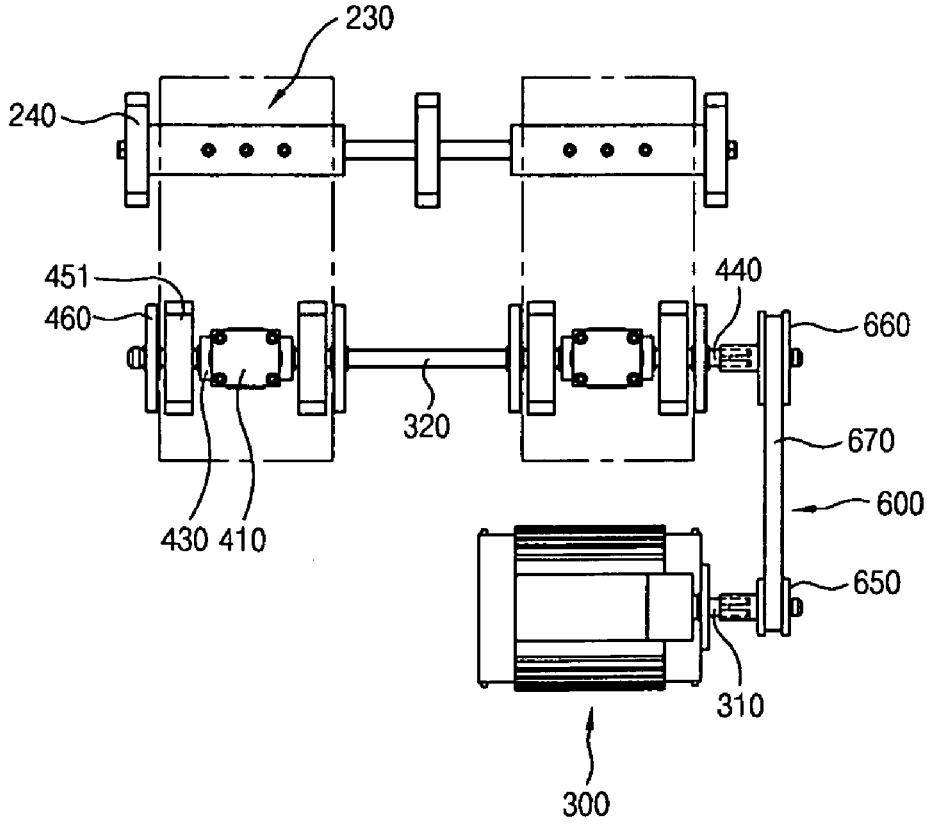

FIG. 29 is a plane view showing another modified exercising apparatus in FIG. 26.

Figure 30:
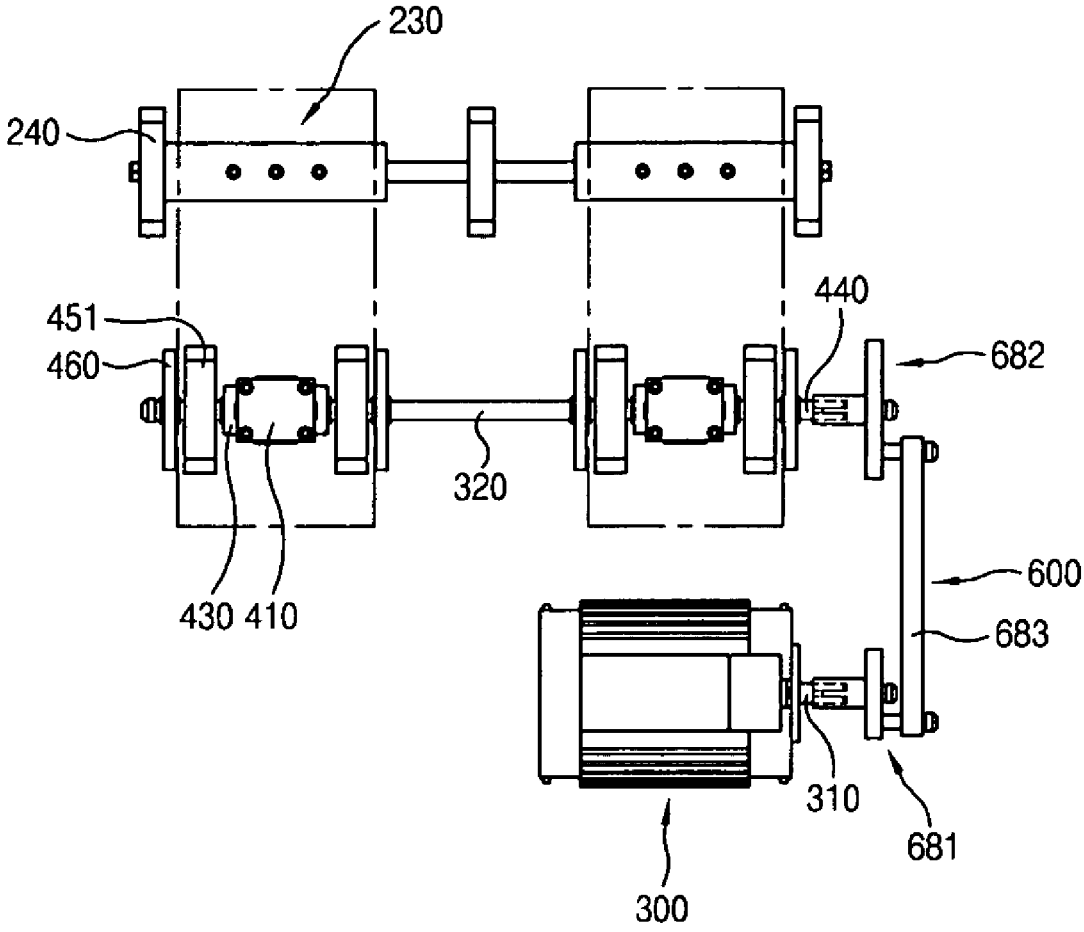

FIG. 30 is a plane view showing the other modified exercising apparatus in FIG. 26.

MODES FOR CARRYING OUT THE PREFERRED EMBODIMENTS

Hereinafter, the exercising apparatus according to the present invention will be explained with reference to the embodiments and the attached drawings in detail.

As show in FIGS. 1 to 3*b*, the exercising apparatus in accordance with the present invention is comprised of at least one motion unit having a moving unit 200 fixedly installed with a hinge unit 230 in one end of the moving unit 200, and an up-and-down reciprocating unit 400 connected with the other end of the moving unit 200, the up-and-down reciprocating unit 400 reciprocating upward and downward and making the moving unit 200 rotate reciprocatingly in an angular interval, and a driving unit 300 connected with the up-and-down reciprocating unit 400 of the motion unit, the driving unit 300 driving the up-and-down reciprocating unit 400 to reciprocate upward and downward.

As show in FIGS. 1 and 2, the exercising apparatus is comprised of a main body 100 formed with a receiving space receiving the driving unit 300 and the motion unit.

And the main body 100, as shown in FIG. 1, is comprised of a covering unit 110 formed with an opening 111 in which the moving unit 200 is installed, and the bottom unit 120 forming the receiving space by being coupled with the covering unit 110.

A post 130 is connected with the main body 100 at one side of the main body 100, and a control unit 140 for controlling the driving unit 300 thereby controlling motion of the motion unit is connected with the post 130 at the top of the post 130. Of course, the installation position of the control unit 140 may be varied according to the designer's convenience.

The control unit 140 is comprised of a panel, and the panel is installed with a manipulation unit 141 having buttons, etc., so that a user may control the operation of the driving unit 300, control circuit (not shown) including control program for fitting the user's physical standards such as weight, etc., a display unit 142 displaying quantity of motion such as Calorie Consumption amount according to the control program, switch for turning on/off the driving unit 300 and the control unit 140.

And the exercising apparatus in accordance with the present invention may further be installed with a grip unit 150 which a user may lean on by putting the user's foot on the upper surface of the motion unit 200 and gripping the grip unit 150, and as shown in FIG. 1, the grip unit 150 may be comprised of first grip 151 connected with the control unit 140 or second grip 152 connected with the main body 100. And at least one of the first grip 151 and the second grip 152 may be installed to the exercising apparatus.

The moving unit 200, as shown in FIGS. 1 and 2, is comprised of a motion panel 210 installed in the opening 111 of the covering unit 110 of the main body 100 and the motion panel 210 is made to move in a reciprocating rotation motion.

The motion panel 210 is formed with one or more coupling holes 212 at one end of the motion panel 210, and the coupling holes 212 are respectively inserted with a screw 213 for connecting the motion panel 210 with the hinge unit 230 described hereinafter, and one or more connecting holes 214 are formed in the other end of the motion panel 210 and the connecting holes 214 are respectively inserted with a screw 215 for connecting the connection unit 410.

And the upper surface of the motion panel 210 is covered with a covering member 220 for covering the connecting holes 212, 214 and making the user's foot or hand comfortable.

In addition, the surface of the covering unit 220 may be formed with a plurality of protrusions 221 for massaging the user's foot or hand Meanwhile, the hinge unit 230, as shown in FIGS. 2 and 3*a*, is comprised of a rotary shaft 231 rotatably installed to a supporting bracket 240 installed on the bottom unit 120, and a hinge member 232 inserted with the rotary shaft 231 and connected with the moving unit 200.

The hinge member 232 is formed with screw holes 232*a* connected with the screws 215 for being connected with the motion panel 210.

The rotary shaft 231 is inserted into a connection hole 241 formed in the supporting bracket 240, and preferably a bearing 242 inserted with the rotary shaft 231 may be installed in the connection hole 241.

The hinge unit 230 may be connected at one end, at a center portion, between one end and the center portion of the moving unit 200, etc.

Additionally a movement prevention unit 250 for preventing movement of the rotary shaft 231 in a shaft direction of the rotary shaft 231 may be installed in the supporting bracket 240.

The movement prevention unit 250, as shown in FIG. 3*a*, may be comprised of a ball 251 maintaining contact state to the end of the rotary shaft 231, and a male screw 252 connected with the supporting bracket 250, the male screw 252 maintaining the contact state of the ball 251 to the end of the rotary shaft 231.

The movement prevention unit 250 prevents the rotary shaft 231 from moving in a shaft direction of the rotary shaft 231 due to the reciprocating rotation of the moving unit 200.

The up-and-down reciprocating unit 400, as shown in FIGS. 2 and 3*b*, is comprised of the driving unit connecting shaft 440 receiving rotation force from the driving unit 300, an eccentric rotary shaft 430 eccentrically connected with the driving unit connecting shaft 440, and at least one link unit 420, one end of the link unit 420 hingedly connected with the other end of the moving unit 200 and the other end of the link unit 420 rotatably connected with the eccentric rotary shaft 430.

The driving unit connecting shaft 440, as shown in FIGS. 2 and 3*b*, may be connected with a driving shaft 310 of the driving unit 300 by a rotation transmitting unit 600 described hereinafter and receiving the rotation force of the driving unit 300, or as shown in FIGS. 8 and 9, may be directly connected with the driving shaft 310 of the driving unit 300 by a coupler 311.

Meanwhile, as shown in FIGS. 2, 3*b* and 3*c*, one or more balance weights 460 of which center is eccentric from the rotation center thereof may be further installed to the driving unit connecting shaft 440 and it is preferable that the center of the weight of the balance weight 460 have an angular difference of 180° from the center of the eccentric rotary shaft 430. The balance weight 460 may reduce the load applying to the driving unit 300 by preventing the counter torque due to the user's weight.

Meanwhile, in spite of not being shown in the drawings, the number of the motion unit may be one, and the various embodiments of the motion unit may be possible according to the number and the arrangements for the motion units. Hereinafter, the embodiments of the exercising apparatus in accordance with the present invention will be described in detail.

And a pair of the motion units may be comprised, and the pair of the motion units may perform up-and-down reciprocating movement at the same time, an up-and-down reciprocating movement alternatively, or an up-and-down reciprocating movement having an angular difference between 0°~180° between the eccentric rotary shafts 430 of the motion units.

Herein, in case that the exercising apparatus in accordance with the present invention is comprised of in a plurality of the motion units, the up-and-down reciprocating units 400 of the motion units may be coupled with each other by a motion coupling unit 500 for restricting the motion pattern of the up-and-down reciprocating motion of the link units 420. The motion coupling unit 500 may be variously comprised of a combination of belt and pulleys, chain, crank (link member), etc.

In particular, the construction of the rotation transmitting unit 600 and the motion coupling unit 500 may be variously comprised of a combination of belt and pulleys, chain, a link member, etc. and the diameters of the coupled pulleys and the radii of the shafts inserted to the link member may be varied in order to reduce or increase rotation speed or rotation force in the construction of the rotation transmitting unit 600 and the motion coupling unit 500

In addition, in case of the combination of belt and pulleys, the pulleys may have tooth structure, and the belt may have an inner surface having tooth structure corresponding to the tooth structure of the pulley, so-called timing pulleys and belt, so that the tooth structures of the pulleys and the belt may maintain the precise angular difference therebetween, and an additional device for controlling the angular difference may be coupled thereto.

In particular, it is advantageous that the tooth structure of the belt coupled to the pulleys enable the adequate control of being maintained in the angular difference between the eccentric rotary shafts coupled with the respective pulleys. In addition, it is advantageous that the tooth structure of the belt and the pulleys enable the setting in various ranges of the angular differences between the eccentric rotary shafts.

In addition, when the exercising apparatus in accordance with the present invention has a plurality of the motion units, the driving units 300 independently driving may be separately coupled to the respective driving unit connecting shafts 440 of the motion units, so that the moving units of the motion units may perform an up-and-down reciprocating movement alternatively, an up-and-down reciprocating movement at the same time, or an up-and-down reciprocating movement having an angular difference by synchronizing the driving units 300, or perform an irregular movements having no connection with each other.

Of course, the belt and the pulleys in the following embodiments, may be used with the timing belt and pulleys.

The exercising apparatus in accordance with the first embodiments of the present invention, as show in FIGS. 1 to 6, a pair of motion units are arranged in a longitudinal direction, and the hinge units 230 face each other.

Herein the supporting bracket 240 supporting the rotary shafts 231 of the respective hinge units 230 may be another member, or formed in one body.

Meanwhile, the driving unit connecting shaft 440, as shown in FIGS. 2 to 6, is rotatably supported by a pair of shaft supporting brackets 451. Herein, a balance weight 460 is connected with the driving unit connecting shaft 440.

And a pair of the eccentric rotary shafts 430, as shown in FIGS. 2 to 6, may be comprised in order to be coupled to the respective ends of the concentric shaft 450 or the respective ends of the driving unit connecting shaft 440.

The link unit 420, as shown in FIGS. 2 to 3*b*, is comprised of a connection unit 410 formed with connection holes 411 connected with the moving unit 200 by screws 215, and a connecting rod 421, one end of the connecting rod 421 being hingedly connected with the connection unit 410 and the other end of the connecting rod 421 being rotatably connected with each eccentric rotary shaft 430.

The connecting rod 421, as shown in FIGS. 2 and 3*b*, may be preferably formed with a insertion hole 421*a* inserted with the eccentric rotary shaft 430, and the insertion hole 421*a* may be preferably installed with a bearing (not shown) for enhancing the rotation of the eccentric rotary shaft 430.

And the connection unit 410 may be embodied in various forms, and as shown in FIGS. 2 and 3*b*, may have 'U' shape for being inserted with the connecting rod 421, and the connection unit 410 is formed with an insertion hole 413 inserted with a hinge pin 412 which is inserted into a insertion hole 421*b* formed in the connecting rod 421 thereby connecting the connecting rod 421 and the connection unit 410.

Meanwhile, the link unit 420 may be installed at the center portion in width of the moving unit 200 for stably supporting the moving unit 200, or as shown in FIGS. 2 and 3*b*, a pair or a plurality of the link units 420 may be installed in order to more stably support the moving unit 200.

And various constructions of the rotation transmitting unit 600 in accordance with the position of the driving unit 300 may be possible, and in the first embodiment of the present invention, as shown in FIGS. 2 and 3*b*, the rotation transmitting unit 600 may be comprised of a driving pulley 650 connected with the driving shaft 310, a slave pulley 660 connected with the driving unit connecting shaft 440, and a belt 670 connecting the driving pulley 650 with the slave pulley 660, thereby transmitting the rotation force from the driving pulley 650 to the slave pulley 660. Herein the driving pulley, as shown in FIG. 3*b*, may be preferably installed at the center portion of the moving unit 200.

Herein, the diameter of the driving pulley 650 may be different from that of the slave pulley 660, and it is advantageous that the smaller diameter of the driving pulley 650 that the diameter of the slave pulley 660 enables the driving of the motion unit by smaller driving force the driving unit 300.

And the driving shaft 310, as shown in FIGS. 2 to 6, may be coupled with the extension shaft 312 rotatably connected with the supporting bracket 240 by a coupler for extending the driving shaft 310. The driving pulley 650 may be connected with the extension shaft 312. Herein the extension shaft 312 may be installed with a pair of driving pulleys 650 in order to transmitting the driving force from the respective driving pulleys 650 to the respective slave pulleys 660 connected with the corresponding driving unit connecting shafts 440 of the motion unit. Herein the driving pulley 650 and the slave pulley 660 may be used with timing pulleys, and, the belt 670 may be also used with a timing belt. And various exercising effects such as symmetrical movement, alternative up-and-down movement, irregular up-and-down movement, etc., may be realized by user's controlling the timing belt connected with the timing pulleys, thereby controlling the angular difference between the eccentric rotary shafts 430 of the up-and-down reciprocating unit 400 positioned at both ends, and setting the angular difference (0° to 180°).

Of course, any construction for transmitting rotation force from the driving shaft 310 of the driving unit 300 to the driving unit connecting shaft 440 such as chain, link member, etc., as well as a combination of belt and pulleys may be possible.

Meanwhile, the motor having a pair of driving shafts may be used as the driving unit 300, the driving unit 300 may be positioned rightly below the center portion of the moving unit 200, and as shown in FIG. 7, the respective driving shafts 310 of the motor may be respectively connected with the driving pulleys 660 and the slave pulleys 660 may be respectively installed outside of the shaft supporting bracket 451.

The exercising apparatus in accordance with the first embodiment of the present invention having the above described construction enables various motion patterns by having an angular difference (0°~180°) between the eccentric rotary shafts 430 of the respective motion units.

And in spite of not shown in the drawings, the exercising apparatus in accordance with the first embodiment of the present invention may be further comprised of a device for controlling the angular difference between the eccentric rotary shafts 430 of the respective motion units by user's control.

Meanwhile, the driving unit 300 may be directly connected with the driving unit connecting shaft 440 of at least one of the motion units, not positioned at the center of the moving unit 200.

The driving unit 300 in the exercising apparatus in accordance with the second embodiment of the present invention, as shown in FIGS. 8 to 16, is directly connected with the driving unit connecting shaft 440. Identical or similar parts of the second embodiment of the present invention with those of the first embodiment without additional description will be omitted for explanation's convenience.

A pair of concentric shafts 450 having the same rotation center with the driving unit connecting shaft 440 may be connected to respective ends of the eccentric rotary shaft 430.

The pair of concentric shafts 450 may be rotatably supported by the shaft supporting bracket 451. In addition, the driving unit connecting shaft 440 may be one of the concentric shafts 450.

Herein the driving unit connecting shaft 440, as shown in FIGS. 8 to 12, may be connected with the driving shaft 310 of the driving unit 300 by a coupler 311.

The eccentric rotation of the eccentric rotary shaft 430 by having a center of the eccentric rotary shaft 430 from the rotation center make the link unit 420 move upward and downward, and the moving unit 200 connected with the link unit 420 reciprocally rotate between a predetermined angular interval centering the hinge unit 230.

Since the eccentric rotary shaft 430 is rotated by being connected with the driving unit connecting shaft 440, various embodiments may be possible by a person having ordinary skills to which the present invention pertains, and as shown in FIGS. 8 to 12, both ends of the driving unit connecting shaft 440 may be connected with a pair of concentric shafts 450 having concentric center with the driving unit connecting shaft 440.

And the pair of the concentric shafts 450 are respectively rotatably supported by the shaft supporting bracket 451. In addition, the driving unit connecting shaft 440 as shown in FIGS. 10 to 12 may be one of the concentric shafts 450.

At least one more balance weights 460 eccentrically connected with one of the concentric shafts 450 may be further installed at one end of one of the concentric shafts 450. Of course, the balance weight 460 may be installed inside or outside of the shaft supporting bracket 451. The installation position of the balance weight 460 may be varied according to the designer's convenience.

Meanwhile, it is required that the respective moving units 200 of the motion units be constructed to move in up-and-down movement according to an uniform pattern such as symmetrical, asymmetrical, irregular, etc. movements. Of course, each motion unit may be separately connected with the driving unit 300.

The exercising apparatus in accordance with the second embodiment of the present invention, as shown in FIGS. 8 to 12, has the up-and-down reciprocating units 400 of the motion units which are connected with each other by a motion coupling unit 500 restricting the angular difference between the eccentric rotary shafts 430, thereby restricting up-and-down movements of the link units 420.

The motion coupling unit 500, as shown in FIGS. 8 to 12, is comprised of a connection link member 510, one end of the connection link member 510 rotatably connected with the eccentric rotary shaft 430 connected with the driving unit 300, and the other end of the connection link member 5 10 rotatably connected with the eccentric rotary shaft 430 connected with the other motion unit.

And the connection link member 510, as shown in FIGS. 8 to 12, is formed with insertion holes inserted with the eccentric rotary shafts 430, and preferably bearings inserted with each eccentric rotary shaft 430 may be installed in the insertion holes for enhancing the rotation of the eccentric rotary shafts 430. In addition, the connection link member 510, as shown in FIGS. 14*a* to 14*c*, may be comprised of pulleys 513 connected to the respective driving unit connecting shafts 450 and a belt 514 connecting the pulleys 513. The diameters of the pulleys as described in the above may be may be different with each other in order to increase or reduce the rotation force or rotation speed.

Meanwhile, the connection link member 510, as shown in FIGS. 8 to 12, may be installed so that the eccentric rotary shafts 460 of the motion units have the angular difference of 180° in order to alternatively make one of the moving units 200 move downward and the other one of the moving units 200 move upward, or as shown in FIG. 13, may be installed so that the eccentric rotary shafts 460 of the motion units have the same angle with each other in order to make the moving units 200 move in the same pattern.

In addition, in case of the connection link member 510 installed with the balance weight 460, as shown in FIGS. 15*a* to 16, connecting pins 461 are formed in the balance weights 460 of the up-and-down reciprocating units 400, and the connection link member 510 may rotatably connect the connecting pins 461.

The pins 461, as shown in FIG. 16, may have an angular difference of 180° from the center of the eccentric rotary shaft 460, or as shown in FIGS. 15*a* to 15*c*, may have the same angle with the center of the eccentric rotary shaft 460. Of course, the angular difference of the connecting pins 461 may be varied between 0°~180°, and in spite of not being in the drawings, the angular difference of the connecting pins 461 may be varied by an additional device for varying the angular difference of the connecting pins 461.

FIG. 16 shows the exercising apparatus having the connecting pins 461 having the same angle in order to the moving units 200 move in the same pattern, and FIGS. 15*a* to 15*c* show the exercising apparatus having the connecting pins 461 having an angular difference of 180° with each other in order to alternatively make one of the moving units 200 move downward and the other one of the moving units 200 move upward.

Meanwhile, it is preferable that the moving units 200 of the motion units may have the same length, but the lengths of the moving units 200 of the motion units may be different with each other considering user's physical characteristics such as differences of the user's leg length, etc.

The moving units 200 may have various widths, and have smaller size than user's foot size so that the moving units support a part of the user's foot and the main body 100 support the other part of the user's foot, or have larger size than user's foot size.

Meanwhile, a pair of the link units 420, as shown in FIG. 17, may more stably support the moving units 200. Herein the motion coupling unit 500 may be installed between the pair of the link units 420.

Meanwhile, the motion unit of the exercising apparatus in accordance with may be comprised of a pair or a plurality of the moving units 200.

In other words, two pairs of the motion units are arranged in two rows, and the moving units 200 of the motion units in the same side may alternatively move upward and downward.

Hereinafter, the exercising apparatus in accordance with the third embodiment of the present invention will be described in detail. Of course, the exercising apparatus in accordance with the third embodiment of the present invention have identical or similar parts of the third embodiment of the present invention with those of the first or the third embodiment without additional description.

The exercising apparatus in accordance with the third embodiment of the present invention, as shown in FIGS. 18 to 19*c*, is comprised of a pair of the moving units 200.

Herein it is preferable that a plurality of the link units 420 of the up-and-down reciprocating unit 400 be comprised, and the eccentric rotary shafts 430 respectively connected with the pair of the link units 420, as shown in FIG. 19*a*, may be comprised first eccentric rotary shaft 431 and second eccentric rotary shaft 432, the first and the second eccentric rotary shafts 431, 432 having angular difference of 180° with each other. Herein, an additional shaft supporting bracket 452 may be installed between the first eccentric rotary shaft 431 and the second eccentric rotary shaft 432 for more stably supporting the eccentric rotary shaft 430, as shown in FIGS. 18 and 19*a*.

Of course, instead of the additional shaft supporting bracket 431 between the first eccentric rotary shaft 431 and the second eccentric rotary shaft 432, as shown in FIG. 19*b*, the first eccentric rotary shaft 431 and the second eccentric rotary shaft 432 may be fixed with each other and rotate together.

Meanwhile, the up-and-down reciprocating unit 400 of the motion unit may have similar construction with that of the first embodiment of the present invention. That is to say, as shown in FIG. 19*c*, a pair of the link units 420 of the up-and-down reciprocating unit 400 may be comprised so that the link units 420 may be connected with both ends of the driving unit connecting shaft 440. The pair of the link units 420 are respectively connected with a pair of the eccentric rotary shafts 430. Herein the pair of the eccentric rotary shafts 430, as shown in FIG. 19*c*, may have angular difference of 180° with each other, but may have an angular difference of 0°~180° with each other as described in the above.

And the driving unit connecting shaft 400, as shown in FIG. 19*c*, may be connected with the driving unit 300 by a rotation transmitting unit 600. The rotation transmitting unit 600, as shown in FIG. 19*c*, may be comprised of a combination of belt and pulleys, and also various constructions such as crank, chain, coupler, etc.

The exercising apparatus in accordance with the third embodiment having the eccentric rotary shaft 430 being comprised of the first eccentric rotary shaft 431 and the second eccentric rotary shaft 432 having angular difference of 180° with each other, as shown in FIGS. 19*a* to 19*c* gives exercising effect of various patterns to user's foot.

That is to say, performing the alternative reciprocating up-and-down movements by the pair of moving units 200 supporting the user's foot may give various exercising effect to user's foot.

Meanwhile, the driving unit 300, as shown in FIG. 20, may be installed at the center portion of the moving unit 200 as in the first embodiment.

Meanwhile, a pair of the motion units of the exercising apparatus in accordance with the present invention may be aligned in a longitudinal direction, and each hinge unit 230 may be installed at each end of the motion unit.

Two pairs of the motion units of the exercising apparatus may be aligned in two rows.

The moving units 200 of the motion units at the same side may perform one of alternative up-and-down movement, equal movement and irregular movement.

Hereinafter, the exercising apparatus in accordance with the fourth embodiment of the present invention will be described in detail. Of course, the exercising apparatus in accordance with the fourth embodiment of the present invention have identical or similar parts of the third embodiment of the present invention with those of the first, the second, or the third embodiment without additional description.

The exercising apparatus in accordance with the fourth embodiment, as shown in FIGS. 21 and 22, is comprised of a pair of the motion units which are aligned in a longitudinal, and the hinge units 230 are installed at each end of the motion units.

Herein, supporting brackets 240 supporting the hinge unit 230, as shown in FIGS. 21 and 22, are respectively installed at the respective ends, and the moving units 200 have lager distance from each other than those of the exercising apparatuses in accordance with the first, the second, the third, and the fourth embodiments of the present invention considering user's step.

Meanwhile, the driving unit 300 of the exercising apparatus in accordance with the second, the third, or the fourth embodiment of the present invention may be installed at the center of the exercising apparatus. The driving unit 300 may be installed at the center of the exercising apparatus, and is connected with the driving unit connecting shafts 440 by a belt (not shown), or by other connecting mechanism such as chain, crank (link member), etc.

Hereinafter, the exercising apparatus in accordance with the fifth embodiment of the present invention will be described in detail. Of course, the exercising apparatus in accordance with the fifth embodiment of the present invention have identical or similar parts of the third embodiment of the present invention with those of the first, the second, the third or the fourth third embodiment without additional description.

The driving unit 300 of the exercising apparatus in accordance with the fifth embodiment of the present invention, as shown in FIGS. 21 to 22, is installed between a pair of the motion units, and a rotation transmitting unit 600 connecting the driving shaft 310 of the driving unit 300 with the driving unit connecting shaft 440 is installed between the pair of the motion units, thereby transmitting rotation force of the driving unit 300 to the driving unit connecting shaft 440.

The rotation transmitting unit 600 is comprised of a main rotary shaft 610 connected with the driving shaft 310 of the driving unit 300; first eccentric shaft 620 having a center eccentric from the rotation center of the main rotary shaft 610, second eccentric shaft 630 having a center eccentric from the rotation center of the main rotary shaft 610, first and second link members 611, 612 respectively connecting the first eccentric shaft 620 and second eccentric shaft 630 with the respective motion units.

The diameters of the first eccentric shaft 620 and the second eccentric shaft 630 are equal with each other, and have an angular difference 180° centering the rotation center of the main rotary shaft 610 or an equal angle.

The first and the second link members 611, 612 respectively connect the first eccentric shaft 620 with the driving unit connecting shaft 440 of one of the motion units, and the second eccentric shaft 630 with the driving unit connecting shaft 440 of the other motion unit. Herein, the driving unit connecting shaft 440 is the eccentric rotary shaft 430 of each motion unit.

The first link member 611 is a link member, one end of the link member rotatably connected with the first eccentric shaft 620 and the other end of the link member rotatably connected with the driving unit connecting shaft 440 of the motion unit, i.e., the eccentric rotary shaft 430.

The second link member 612 is a link member, one end of the second link member 612 rotatably connected with the second eccentric shaft 630 and the other end of the second link member is rotatably connected with the driving unit connecting shaft 440 of the motion unit, i.e., the eccentric rotary shaft 430.

Preferably additional bearings may be respectively installed in the first and the second link members 611, 612 for enhancing rotations of the first eccentric shaft 620, the second eccentric shaft 630, or the driving unit connecting shaft 440.

Meanwhile, the main rotary shaft 610, as shown in FIGS. 22 to 23, is rotatably supported by the main shaft supporting bracket 640 installed in the bottom unit 120 of the main body 100.

Meanwhile, the first and the second link members 611, 612 may be a belt, and in case of a belt, pulleys (not shown) instead of the first eccentric shaft 620 and the second eccentric shaft 630 are respectively installed at the main rotary shaft 610 and the respective driving unit connecting shafts 440 of the motion units. Herein the driving unit connecting shaft 440 differing from the eccentric rotary shaft 430 is not eccentric.

FIGS. 22 to 24 respectively show the embodiments to which the second, third and fourth embodiments are applied with fifth embodiment.

Meanwhile, various embodiments of connection of the up-and-down reciprocating unit and the driving unit of the motion unit in the exercising apparatus in accordance with the present invention may be possible by a person having ordinary skills to which the present invention pertains.

In particular, the up-and-down reciprocating unit 400 of the exercising apparatus in accordance with the sixth embodiment of the present invention, as shown in FIG. 25*a*, is comprised of a driving unit connecting shaft 440 which is eccentrically connected with the driving shaft 310 of the driving unit 300 by a coupler 311 and eccentrically rotates from the rotation center of the driving shaft 310, and a link unit 420, one end of the link unit 420 being hingedly connected with the other end of the moving unit 200 and the other end of the link unit 420 being rotatably connected with the driving unit connecting shaft 440.

The up-and-down reciprocating unit 400, as shown in FIGS. 25*a* and 25*b*, is comprised of a concentric shaft 450 rotatably supported by shaft supporting brackets 451, a eccentric rotary shaft 430 connected with at least one end of the concentric shaft 450 and eccentric from the rotation center of the concentric shaft 450, and a link unit 420, one end of the link unit 420 being rotatably connected with the eccentric rotary shaft 430 and the other end of the link unit 420 being hingedly connected with the moving unit 200, and the driving unit 300 is connected with one of the concentric shaft 450 and the eccentric rotary shaft 430 for transmitting rotation force.

The driving shaft 310 of the driving unit 300, as shown in FIG. 25*b*, is connected with the concentric shaft 450 by a rotation transmitting unit 600, and so that rotation force is transmitted from the driving shaft 310 to the concentric shaft 450.

Various embodiments of the rotation transmitting unit 600 are possible, and as shown in FIG. 25*b*, the rotation transmitting unit 600 may be comprised of pulleys respectively connected with the driving shaft 310 and the concentric shaft 450, and a belt connecting the pulleys. Herein the differentiation of the diameters of the pulleys may enhance increase or reduction of rotation speed or rotation force. In addition, the rotation transmitting unit 600 may be comprised of similar one with that as in shown in FIG. 16.

That is to say, the rotation transmitting unit 600 may be comprised of a connection member which connects an eccentric driving shaft eccentrically connected with the end of the driving shaft 310 with the eccentric rotary shaft 430.

The connection member may be comprised of a combination of pulleys and belt, or link member such as chain, crank (link member), etc. Herein the differentiation of the diameters of the pulleys may enhance increase or reduction of rotation speed or rotation force.

Meanwhile, the driving shaft 310 of the driving unit 300 may be connected with the eccentric rotary shaft 430 by a coupler 311. That is to say, the eccentric rotary shaft 430 is the same member with the driving unit connecting shaft 440.

Of course, a pair of the moving units 200 are aligned in a longitudinal direction parallel with each other.

And the link unit 420 may be comprised of a connection unit 410 formed with connection holes 411 for being connected with the moving unit 200 by screws 215, a connecting rod 421, one end of the connecting rod 421 being hingedly connected with the connection unit 410, and the other end of the connecting rod 421 being rotatably connected with the eccentric rotary shaft 430.

Herein, a plurality of the link units 420 may be comprised, and the up-and-down reciprocating unit 400, as shown in FIG. 25*a*, may include a concentric shaft 450 having the same rotation center with the driving shaft 310, and one end of the concentric shaft 450 being fixedly connected with the eccentric rotary shaft 430, i.e., the driving unit connecting shaft 440 and the other end of the concentric shaft 450 being fixedly connected with additional eccentric rotary shaft 430 connected with additional link unit 420.

And the concentric shaft 450, as shown in FIG. 25*a*, is rotatably supported by at least one shaft supporting bracket 451. And balance weight 460 as shown in FIG. 25*a* may be further installed to the concentric shaft 450 in order to balancing counter moment applied by user's weight.

Meanwhile, in the link unit 420 in the up-and-down reciprocating unit 400 of the exercising apparatus of the present invention, as shown in FIGS. 25*a* and 25*b*, the concentric shaft 450 is installed at the center, and the link unit 420 may be comprised of a pair of the eccentric rotary shafts 430 rotating eccentrically from the concentric shaft 450 and being connected with the respective ends of the concentric shaft 450.

Herein, each eccentric rotary shaft 430 is rotatably connected with the above link unit 420.

Meanwhile, in connection with the third embodiment of the present invention, one ends of the pair of the link units 420 are respectively connected with first eccentric rotary shaft 431 and second eccentric rotary shaft 432 having angular difference of 180° with each other, and the other ends of the pair of the link units 420 are respectively connected with the respective moving units 200.

And the driving unit 300, as shown in FIG. 25*a*, may be directly connected with the driving unit 300 being directly transmitted with the driving force of the driving unit 300 to the up-and-down reciprocating unit 400, but also, as shown in FIG. 25*b*, may be indirectly connected by a combination of a belt 340 and pulleys 330 indirectly transmitted with the driving force of the driving unit 300. That is to say, the belt 340 is connected with the driving shaft of the driving unit 300, so that the rotation force of the driving shaft 310 of the driving unit 300 to pulleys 330 via the belt 340 and rotate the concentric shaft 450. Herein the differentiation of the diameters of the pulleys may enhance increase or reduction of rotation speed or rotation force.

Meanwhile, a pair of the motion units of the exercising apparatus in accordance with the present invention may be aligned parallel with each other.

Hereinafter, the exercising apparatus in accordance with the seventh embodiment of the present invention will be described in detail. Of course, the exercising apparatus in accordance with the seventh embodiment of the present invention have identical or similar parts of the third embodiment of the present invention with those of the first and the second embodiments without additional description.

In the exercising apparatus in accordance with the seventh embodiment of the present invention, as shown in FIGS. 26 to 30, a pair of the motion units may be aligned parallel with each other.

Herein a pair of the driving units 300 are respectively connected to the pair of the motion units, and as shown in FIGS. 26 and 30, the driving unit 300 may be comprised of a motor which has a pair of driving shafts 310 at both ends thereof and is installed between the pair of the motion units perpendicular to a longitudinal direction of the moving unit 200.

And the respective ends of the driving shafts 310 of the driving units 300 are respectively connected with the driving unit connecting shafts 440 of the up-and-down reciprocating units 400, thereby transmitting rotation force to the up-and-down reciprocating unit 400.

And separate supporting brackets 240 supporting the respective the hinge units 230, as shown in FIG. 26 are separately installed.

Meanwhile, the hinge unit 230 of the moving unit 200 may be installed at the end of the moving unit 200, but as shown in FIG. 27, may be installed at center portion of the moving unit 200 or between the end and the center portion of the moving unit. And preferably, the length of the moving unit 200 may be larger than that of user's foot.

And the motion pattern of the up-and-down reciprocating units 400 may be symmetrical with each other as in the second embodiment of the present invention, or asymmetrical with each other.

Meanwhile, the driving unit 300 of the exercising apparatus of the seventh embodiment of the present invention instead of being installed between the pair of the motion units, as shown in FIG. 28, may be installed at one side of one of the pair of the motion units, the driving shaft 310 of the driving unit 300 is connected with one of the pair of the motion units, and a connection shaft 320 may be further installed between the motion units for being transmitted with the driving force from the motion unit connected with the driving shaft 310.

The connection shaft 320, as shown in FIG. 28, is connected with the concentric shafts 450 of the up-and-down reciprocating units 400, and the rotation of one of the concentric shafts 450 of the motion units rotate the other one of the concentric shafts 450 of the motion units, so that the respective up-and-down reciprocating units 400 of the motion units may perform the up-and-down movements.

Meanwhile, instead of directly connecting the driving unit 300 with driving unit connecting shaft 440, the driving unit 300 and driving unit connecting shaft 440 may be connected with each other by a rotation transmitting unit such as a combination of a belt and pulleys, crank (link member), chain, etc.

The rotation transmitting unit 600, as shown in FIG. 29, may be comprised of a belt and pulleys. That is to say, the rotation transmitting unit 600, as shown in FIG. 29, a driving pulley 650 connected with the driving shaft 310 of the driving unit 300, a slave pulley 660 connected with the driving unit connecting shaft 440, and a belt connecting the driving pulley 650 and slave pulley 660. The diameters of the pulleys as described in the above may be may be different with each other in order to increase or reduce the rotation force or rotation speed.

In addition, the rotation transmitting unit 660, as shown in FIG. 30, may be comprised of first sub driving unit 681 connected with the driving shaft 310 of the driving unit 300, second sub driving unit 682 connected with the driving unit connecting shaft 440, and a link member 683 which connects the first sub driving unit 681 and the second sub driving unit 682 and transmits rotation force from the driving shaft 310 to the driving unit connecting shaft 440.

Herein the first sub driving unit 681 and the second sub driving unit 682 may be eccentric from rotation center thereof, and the eccentric distance of the first sub driving unit 681 is less than that of the second sub driving unit 682 so that the driving unit 300 may rotate the eccentric rotary shaft 430 with smaller driving force.

User may have exercising effect such as body lipolysis or strengthening muscles, etc., by putting the user's hands or feet on the moving units of the exercising apparatus in accordance with the present invention and controlling the operation via the control unit, thereby making the moving units move in a reciprocating rotating motion.

The exercising apparatus in accordance with the present invention has an advantage that the exercising apparatus is capable to provide user with exercising effect such as body lipolysis or strengthening muscles, etc., without user's active motion.

In particular, the exercising apparatus in accordance with the present invention has an advantage that the exercising apparatus is capable to provide a disabled person unable to actively move such as a person having paralysis in the lower part of the body with exercising effect.

Also the exercising apparatus in accordance with the present invention has an advantage that the present invention is to provide the exercising apparatus capable of having various motion patterns by being comprised of a plurality of motion units reciprocatingly rotating in a predetermined angular interval.

The invention claimed is:

1. An exercising apparatus comprising:

at least one motion unit, each motion unit including a moving unit installed at one end thereof with a hinge unit rotatably fixed; and an up-and-down reciprocating unit connected with the other end of the moving unit, the up-and-down reciprocating units reciprocating upward and downward and making the moving units rotate in an angular interval; and wherein a driving unit is connected with the up-and-down reciprocating units of the at least one motion unit, the driving unit driving the up-and-down reciprocating units to reciprocate upward and downward;

wherein a pair of the motion units are arranged in a longitudinal direction thereof, and the hinge units of the pair of the motion units face each other;

wherein each up-and-down reciprocating unit comprises:

a driving unit connecting shaft to which rotating force is transmitted from the driving unit;

an eccentric rotary shaft eccentrically connected with the driving unit connecting shaft; and at least one link unit, one end of the link unit hingedly connected with the other end of the moving unit, and the other end of the link unit rotatably connected with the eccentric rotary shaft; and wherein the driving unit is a motor having a pair of driving shafts respectively at ends of the motor, the respective driving shafts are connected with the driving unit connecting shafts of the respective motion units by a rotation transmitting unit; and wherein further, the rotation transmitting unit comprises pulleys respectively connected with the driving shaft and the concentric shaft and a belt connecting the pulleys.

2. The exercising apparatus of claim 1, wherein the up-and-down reciprocating units of the respective motion units are coupled with each other by a motion coupling unit restricting an angular difference between the respective eccentric rotary shafts and restricting up-and-down motion of each link unit.

3. The exercising apparatus of claim 2, wherein the motion coupling unit comprises pulleys respectively connected with the driving unit connecting shafts of the pair of the motion units, and a belt connecting the pulleys.

4. The exercising apparatus of claim 3, wherein the pulleys have an outer surface having tooth structure, and the belt has an inner surface having tooth structure corresponding to the tooth structure of the pulleys.

5. The exercising apparatus of claim 1, wherein both ends of the eccentric rotary shaft are respectively connected to a pair of concentric shafts having the same center.

6. The exercising apparatus of claim 5, wherein the pair of concentric shafts are rotatably supported by a shaft supporting bracket.

7. The exercising apparatus of claim 5, wherein one end of any one of the pair of the concentric shafts is further connected with a balance weight eccentrically from the concentric shaft.

8. The exercising apparatus of claim 1, wherein the eccentric rotary shafts of the pair of the motion units have an angular difference of 0°~180° with each other.

9. The exercising apparatus of claim 1, wherein the number of the link units is two.

10. The exercising apparatus of claim 1, wherein the rotation transmitting unit comprises:

a driving pulley connected with the driving shaft;

a slave pulley connected with the driving unit connecting shaft; and a belt connecting the driving pulley with the slave pulley.

11. The exercising apparatus of claim 10, wherein outer surfaces of the driving pulley and the slave pulley have a tooth structure, and an inner surface of the belt has a tooth structure corresponding to the tooth structure of the driving pulley and the slave pulley.

12. An exercising apparatus comprising:

at least one motion unit, each motion unit including a moving unit installed at one end thereof with a hinge unit rotatably fixed and an up-and-down reciprocating unit connected with the other end of the moving unit, the up-and-down reciprocating units reciprocating upward and downward and making the moving units rotate in an angular interval; and wherein a driving unit is connected with the up-and-down reciprocating units of the at least one motion unit, the driving unit driving the up-and-down reciprocating units to reciprocate upward and downward;

wherein a pair of the motion units are arranged in a longitudinal direction thereof, and the binge units of the pair of the motion units face each; and wherein each up-and-down reciprocating unit comprises:

a concentric shaft rotatably supported by a shaft supporting bracket; an eccentric rotary shaft connected with at least one end of the concentric shaft, the eccentric rotary shaft being eccentric from the rotation center of the concentric shaft; and a link unit, one end of the link unit rotatably connected with the eccentric rotary shaft and the other end of the link unit hingedly connected with the respective moving unit, and the driving unit is connected with one of the concentric shaft and the eccentric rotary shaft in order to transmit rotation thereto.

13. The exercising apparatus of claim 12, wherein a driving shaft of the driving unit is connected with the concentric shaft by a rotation transmitting unit, and the rotation transmitting unit transmits rotation force from the driving shaft to the concentric shaft.

14. The exercising apparatus of claim 13, wherein the rotation transmitting unit comprises pulleys respectively connected with the driving shaft and the concentric shaft and a belt connecting the pulleys.

15. The exercising apparatus of claim 12, wherein a driving shaft of the driving unit is connected with the eccentric rotary shaft by a coupler.

16. An exercising apparatus comprising:

at least one motion unit, each motion unit including a moving unit installed at one end thereof with a hinge unit rotatably fixed and an up-and-down reciprocating unit connected with the other end of the moving unit, the up-and-down reciprocating units reciprocating upward and downward and making the moving units rotate in an angular interval; and wherein a driving unit is connected with the up-and-down reciprocating units of at least one motion unit, the driving unit driving the up-and-down reciprocating units to reciprocate upward and downward;

wherein a pair of the motion units are arranged in a longitudinal direction thereof, and the hinge units are arranged in the respective ends of the pair of the motion units;

wherein each up-and-down reciprocating unit comprises:

a driving unit connecting shaft to which rotating force is transmitted from the driving unit;

an eccentric rotary shaft eccentrically connected with the driving unit connecting shaft; and at least one link unit, one end of the link unit hingedly connected with the other end of the respective moving unit, and the other end of the link unit rotatably connected with the eccentric rotary shaft;

wherein the driving unit is a motor having a pair of driving shafts respectively at ends of the motor, the respective driving shafts are connected with the driving unit connecting shafts of the respective motion units by a rotation transmitting unit; and wherein the rotation transmitting unit comprises pulleys respectively connected with the driving shaft and the concentric shaft and a belt connecting the pulleys.

17. The exercising apparatus of claim 16, wherein the up-and-down reciprocating units of the respective motion units are coupled with each other by a motion coupling unit restricting an angular difference between the respective eccentric rotary shafts and restricting up-and-down motion of each link unit.

18. The exercising apparatus of claim 17, wherein the motion coupling unit comprises pulleys respectively connected with the driving unit connecting shafts of the pair of the motion units, and a belt connecting the pulleys.

19. The exercising apparatus of claim 18, wherein the pulleys have an outer surface having tooth structure, and the belt has an inner surface having tooth structure corresponding to the tooth structure of the pulleys.

20. The exercising apparatus of claim 16, wherein both ends of the eccentric rotary shaft are respectively connected to a pair of concentric shafts having the same center.

21. The exercising apparatus of claim 20, wherein the pair of concentric shafts are rotatably supported by a shaft supporting bracket.

22. The exercising apparatus of claim 20, wherein one end of any one of the pair of the concentric shafts is further connected with a balance weight eccentrically from the concentric shaft.

23. The exercising apparatus of claim 16, wherein the eccentric rotary shafts of the pair of the motion units have an angular difference of 0°~180° with each other.

24. The exercising apparatus of claim 16, wherein the number of link units is two.

25. The exercising apparatus of claim 16, wherein the rotation transmitting unit comprises:

a driving pulley connected with the driving shaft;

a slave pulley connected with the driving unit connecting shaft; and a belt connecting the driving pulley with the slave pulley.

* * * * *